US005699811A

United States Patent [19]

Paine, III

[11] Patent Number: 5,699,811

[45] Date of Patent: Dec. 23, 1997

[54] USE OF EITELITE TO REDUCE SIDESTREAM SMOKE

[75] Inventor: John B. Paine, III, Midlothian, Va.

[73] Assignee: Philip Morris Incorporated, New York, N.Y.

[21] Appl. No.: 689,433

[22] Filed: Aug. 8, 1996

[51] Int. Cl.[6] ..... A24D 1/02

[52] U.S. Cl. ..... 131/365; 131/360; 131/139

[58] Field of Search ..... 131/360, 365; 162/139

[56] References Cited

U.S. PATENT DOCUMENTS 4,433,697 2/1984 Cline et al. ..... 131/365

5,060,674 10/1991 Brown et al. ..... 131/365

5,121,759 6/1992 Dixit et al. ..... 131/365

5,228,463 7/1993 Fournier et al. ..... 131/365

5,253,660 10/1993 Dixit et al. ..... 131/365

*Primary Examiner*—Vincent Millin

*Assistant Examiner*—Eric P. Raciti

*Attorney, Agent, or Firm*—James T. Moore; James E. Schardt; Charles E. B. Glenn

[57] ABSTRACT

Mineral phase eitelite [$Na_2Mg(CO_3)_2$], either alone or in combination with other filters, significantly reduces the amount of sidestream smoke produced by the burning smoking article while providing the smoking article with good ashing characteristics.

15 Claims, 25 Drawing Sheets

USE OF EITELITE TO REDUCE SIDESTREAM SMOKE

BACKGROUND OF THE INVENTION

A. Technical Field of the Invention

The present invention relates to compositions which may be used as novel fillers for smoking article wrappers.

B. Description of the Prior Art

Sidestream smoke is the smoke given off by the burning end of a cigarette or a cigarette-like smoking article between puffs. Such smoke may be objectionable to some of those near the smoker who are not smoking or who do not smoke. Therefore, cigarettes that produce less sidestream smoke are highly desirable.

Several attempts have been made to reduce sidestream smoke through the use of various compounds as fillers for smoking article wrappers. For example, magnesium hydroxide and magnesium oxide have been reported to reduce sidestream smoke in cigarettes. See, e.g., U.S. Pat. Nos. 4,941,485, 4,915,118, 4,881,557, 4,433,697, and 4,231,377.

However, such compounds may not provide good ash coherence. In addition, some compounds may not be readily available or may not be compatible with standard papermaking machinery.

Accordingly, novel fillers for smoking article wrappers which do not incur or which substantially alleviate the above-noted problems or disadvantages are highly desireable.

C. Objects of the Invention

It is therefore an object of this invention to provide a smoking article wrapper designed to consistently reduce sidestream smoke.

Another object of the present invention is to provide a smoking article with coherent ash.

Another object of the present invention is to provide a composition that is efficiently synthesized from readily available starting materials.

Another object of the present invention is to provide a composition that can be incorporated into a paper wrapper as a filler using standard papermaking machinery.

SUMMARY OF THE INVENTION

A primary aspect of the present invention is an inorganic magnesium composition, the mineral phase eitelite [$Na_2Mg(CO_3)_2$], used as filler in smoking article wrappers which substantially reduce the amount of sidestream smoke produced by the burning smoking article while providing the smoking article with good ashing characteristics.

In another aspect, the present invention relates to the use of the mineral phase eitelite [$Na_2Mg(CO_3)_2$] in combination with other fillers, such as calcium carbonate.

In yet another aspect of the present invention, the eitelite may be anhydrous, partially hydrolyzed, or a combination of the two.

In yet another aspect, the present invention relates to sidestream smoke emission reduction thought to occur by the formation of a ceramic sheath.

In yet another aspect, the present invention relates to sidestream reduction involving a self-sealing of the paper by the induced condensation of volatiles from the vapor phase.

In yet another aspect, the present invention relates to the use of eitelite which promotes or leads to improved fluxing action and retards the transit of visible sidestream smoke.

In yet another aspect of the present invention, the use of eitelite yields enhanced ash coherence which is beneficial.

In yet another aspect, the present invention relates to the use of eitelite together with sizing agents such as potassium salts.

These and other objects, aspects, and advantages of the present invention will become apparent from the following detailed description.

(Note: in the description above, "EDS" stands for "Energy Dispersive X-Ray Spectroscopy". The various metallic constituents appear as peaks in the respective traces. Peaks for precious metals are artifacts of sample preparation.)

DETAILED DESCRIPTION

The present invention relates to compositions which are useful as, e.g. novel fillers for smoking article wrappers for tobacco and tobacco-containing products. As used herein, the term tobacco or tobacco charge includes not only cut tobacco leaf filler usually found in cigarettes, but also includes expanded tobacco, extruded tobacco, reconstituted tobacco, tobacco stems, tobacco substitutes, and synthetic tobacco, and blends thereof. A tobacco rod includes any substantially cylindrical, tobacco-containing compositions for a smoking article, e.g., a cigarette.

The mineral phase eitelite [$Na_2Mg(CO_3)_2$] has now unexpectedly been found to be effective in reducing the emission of sidestream smoke from cigarettes of standard configurations. Eitelite consistently gives effective reduction in sidestream smoke emission. In addition, cigarette ash from cigarette wrappers containing eitelite are coherent. Eitelite can be easily and efficiently synthesized from precursors that are inexpensive and available in USP grades in large quantities. Further, eitelite can be incorporated as a filler in paper using standard papermaking machinery.

FIG. 1 and FIG. 2 display photomicrographs of eitelite variously at 1000×, 5000×, or 10,000× magnification. Prominent forms include the 6 faces of the rhombohedron {01$\bar{1}$2}, and the 2 faces of the basal pinacoid {0001}. Also present as small modifying faces are the 6 faces of unit rhombohedron {10$\bar{1}$1}. Note the change in crystal habit and size that occurs as the reaction time under which eitelite is synthesized is increased from several hours (FIG. 1) to several days (FIG. 2).

Figure 1A:
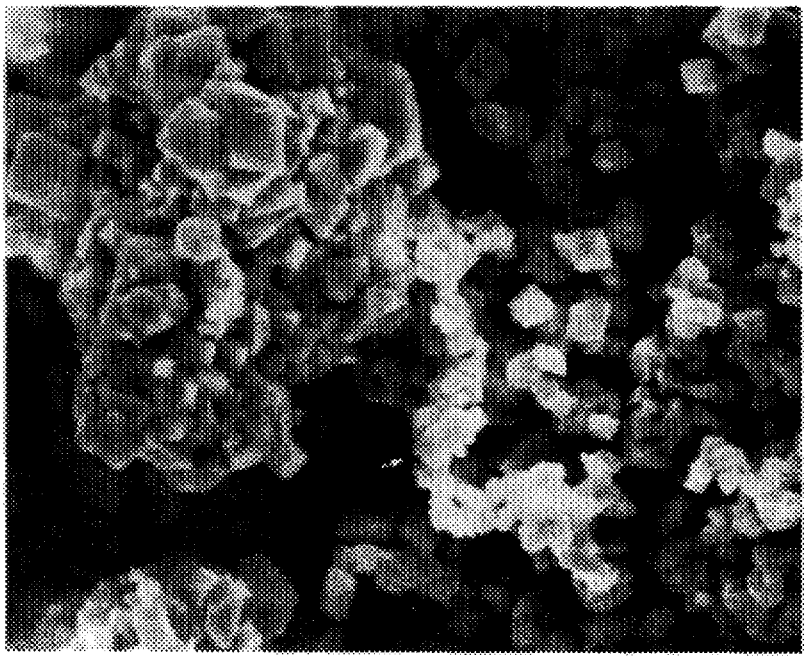
FIG. 1*a* is a photomicrograph of anhydrous eitelite at 1000× (A)
Figure 1B:
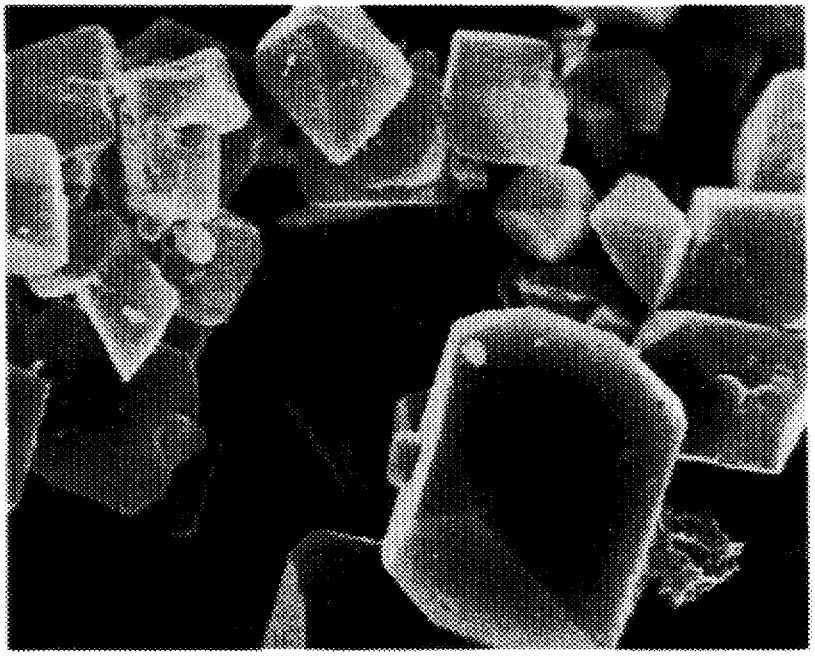
FIG. 1*b* is a photomicrograph of anhydrous eitelite at 5000× (B)
Figure 1C:
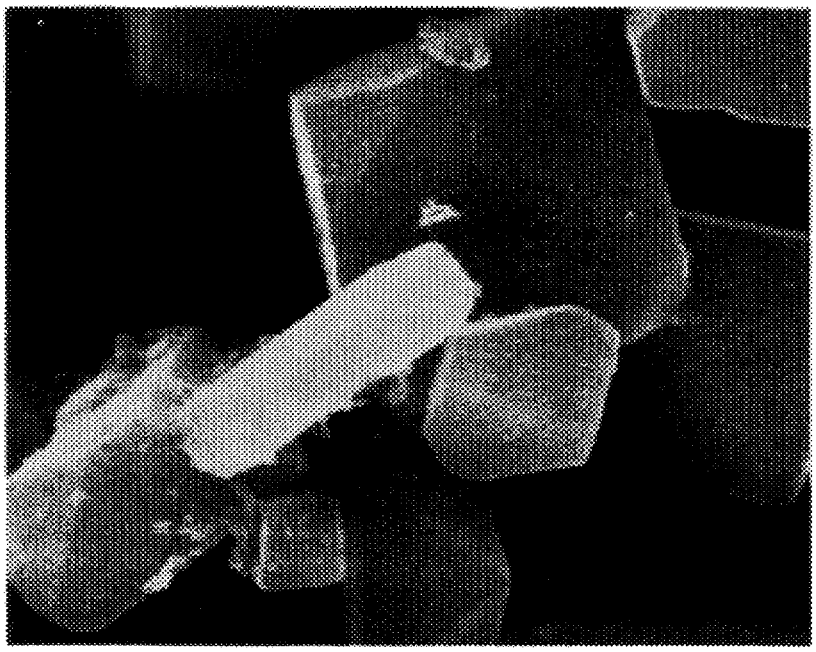
FIG. 1*c* is a photomicrograph of anhydrous eitelite at 10,000× (C)
Figure 1D:
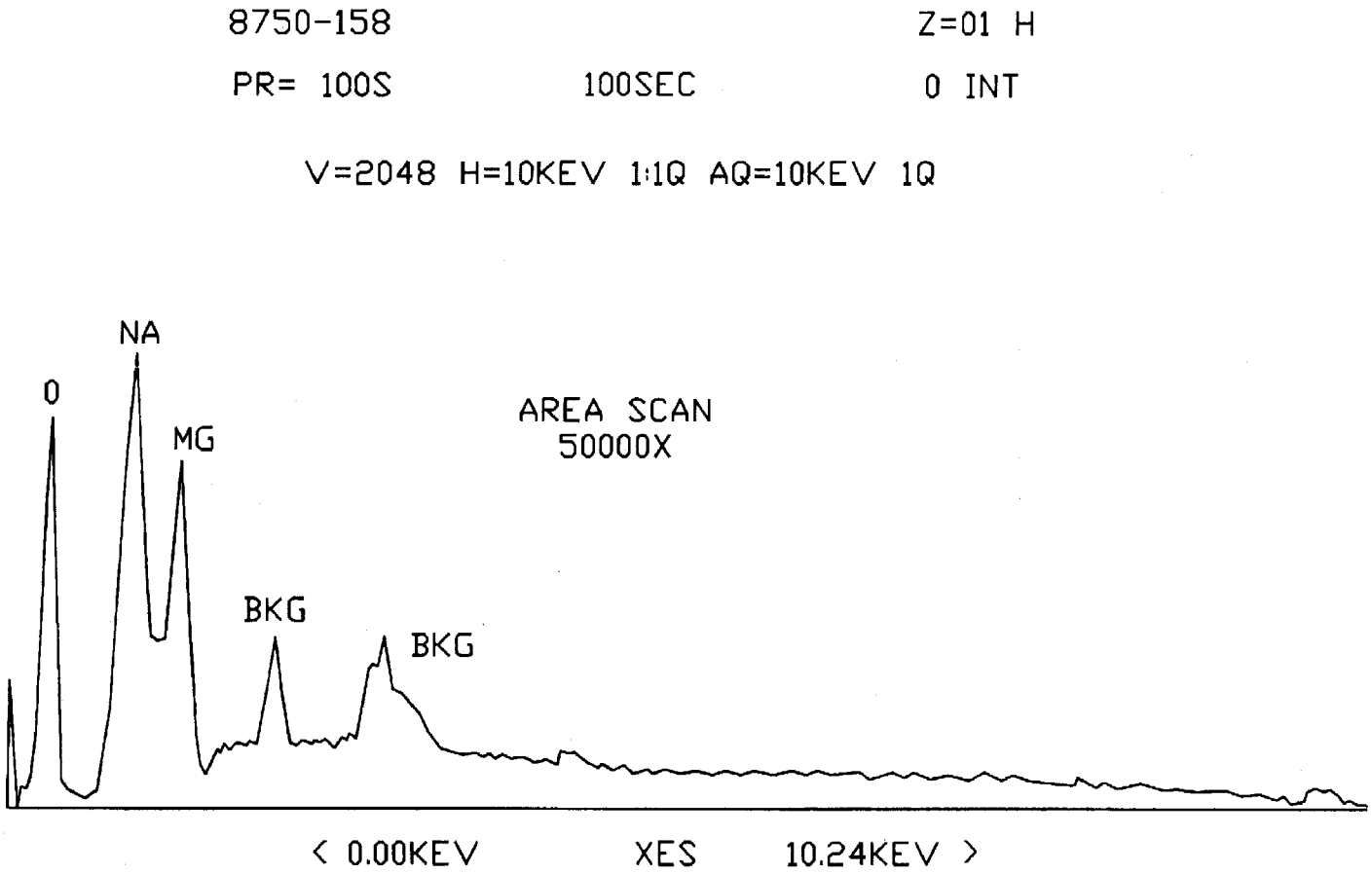
FIG. 1*d* is an EDS scan confirming the presence of sodium and magnesium.
Figure 2A:
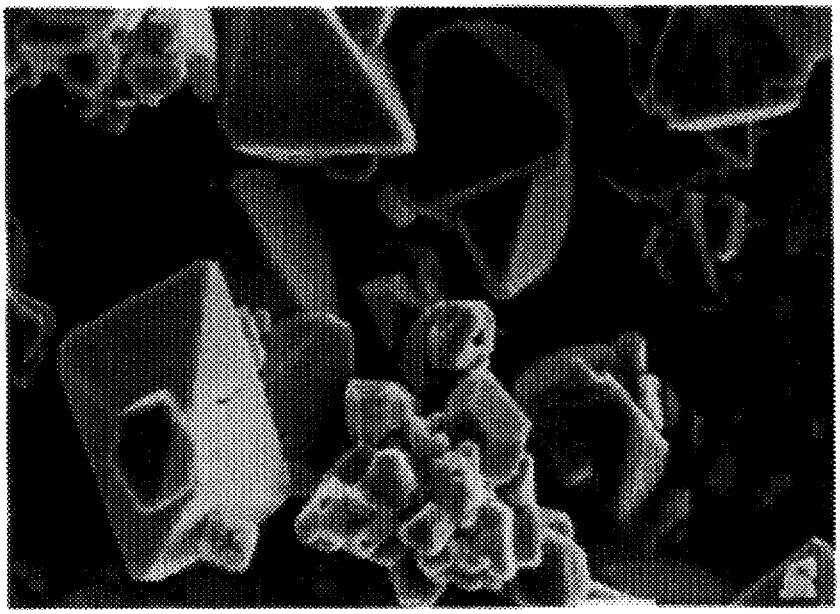
FIGS. 2*a*, 2*b*, and 2*c* are photomicrographs of anhydrous eitelite (resulting after a 2-day synthesis time), all at 1000× (A, B, and C)
Figure 2B:
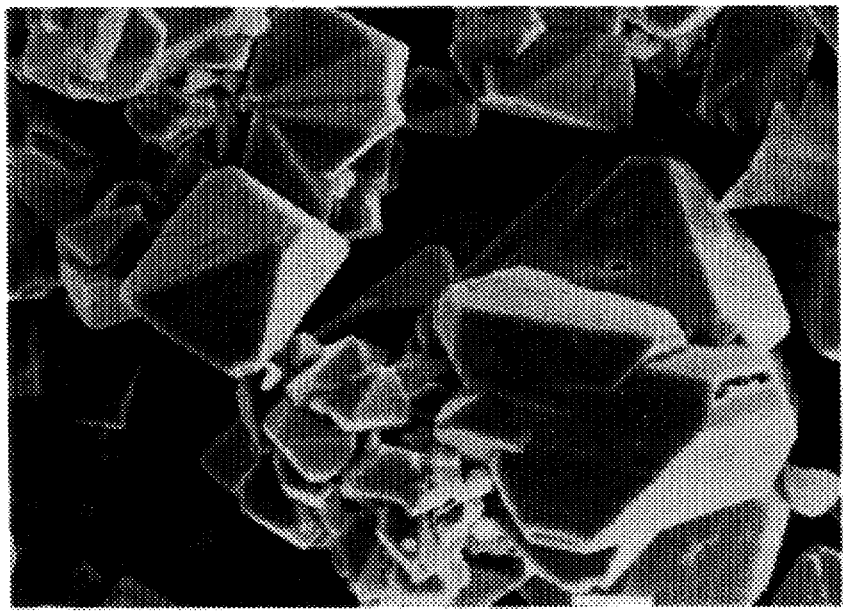
Figure 2C:
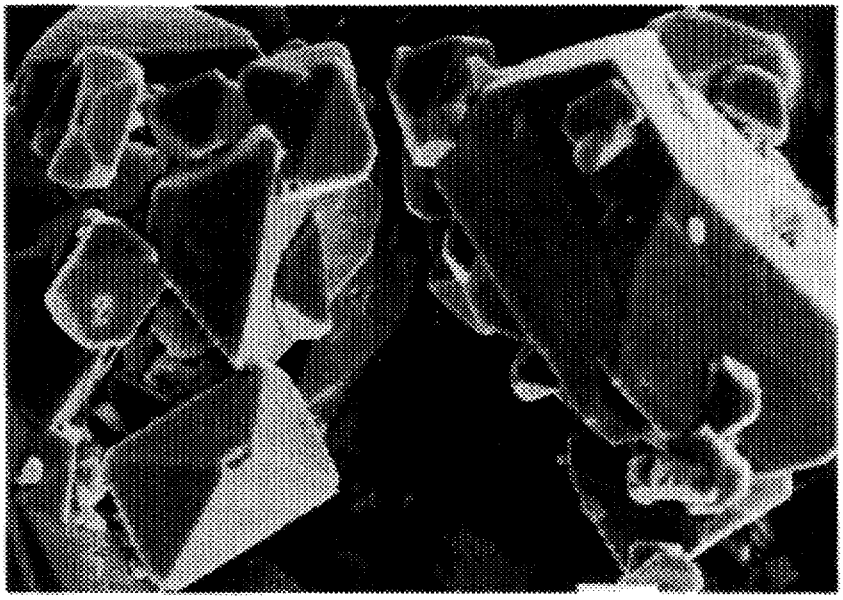
Figure 2D:
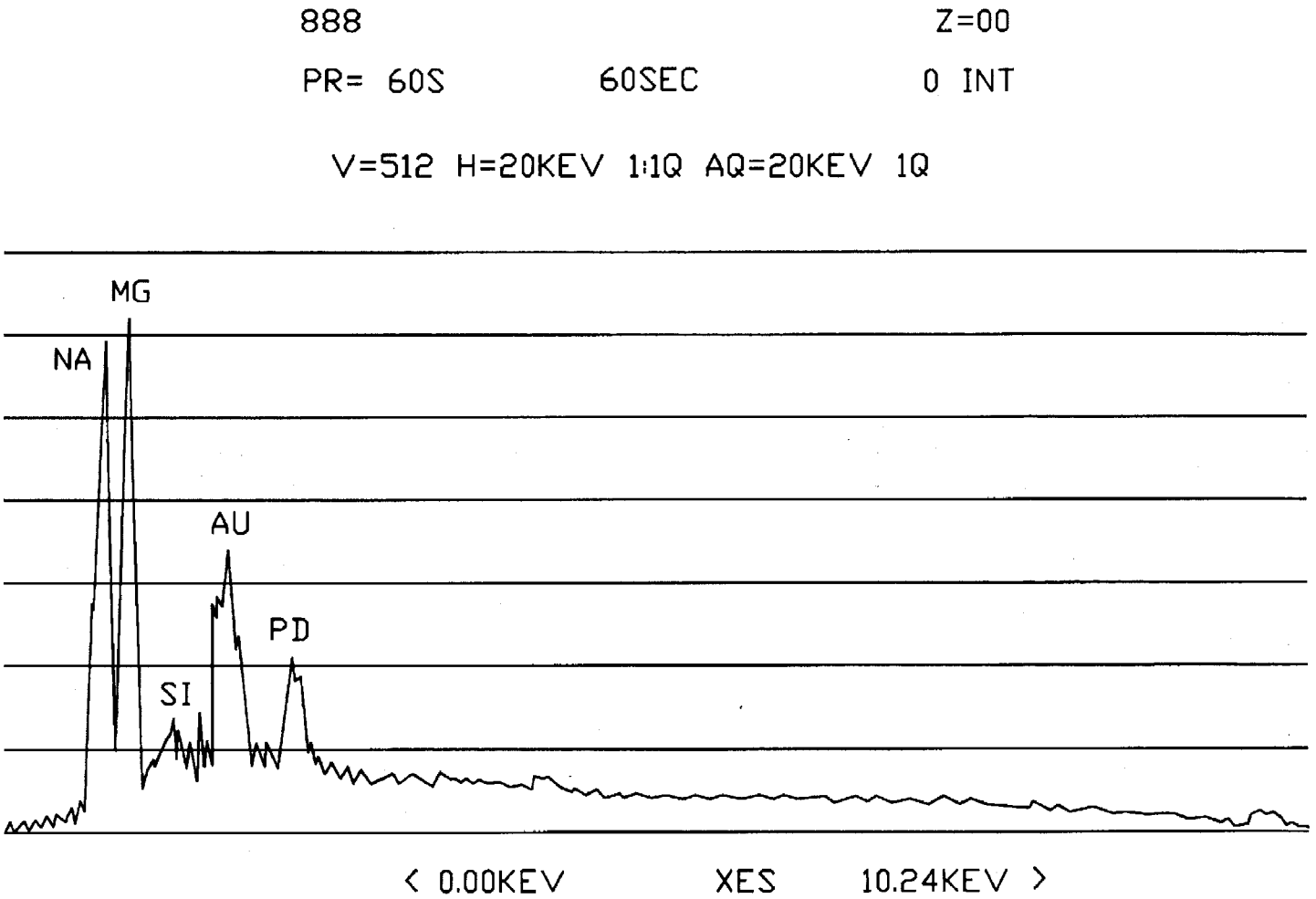
FIG. 2*d* is an EDS scan (D) confirming the presence of sodium and magnesium.
Figure 3:
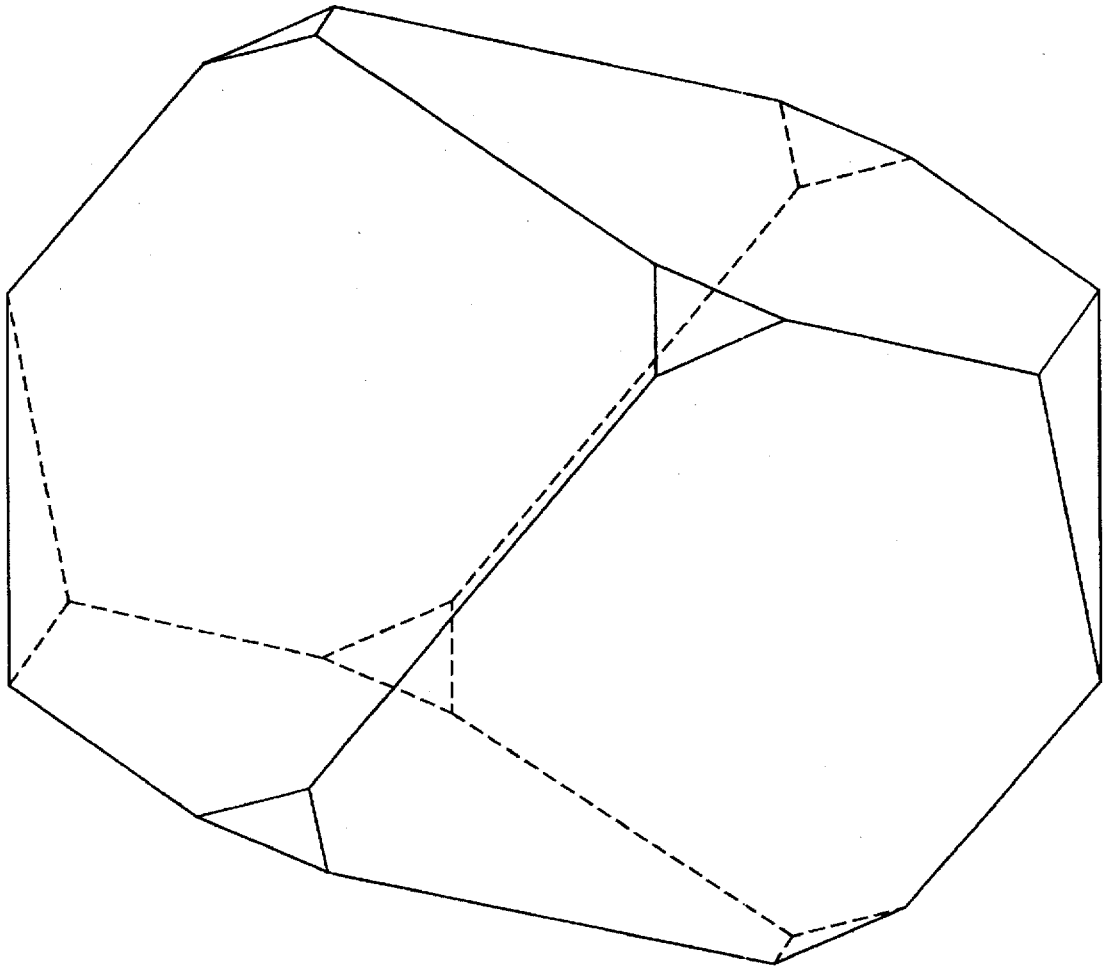
FIG. 3 is a computed crystal drawing of an eitelite crystal displaying in perspective the rhombohedron form depicted in FIG. 1*b;*
Figure 4:
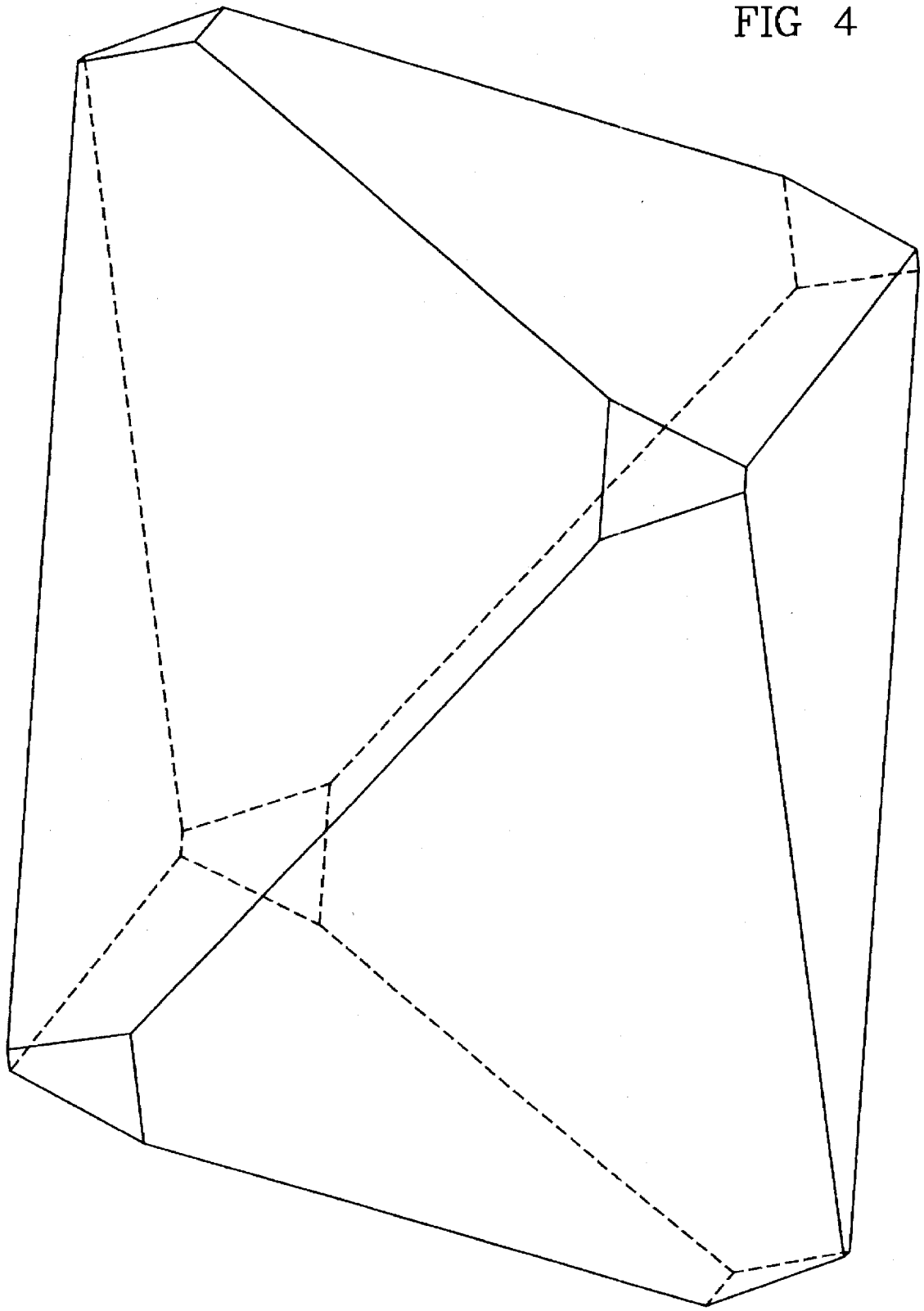
FIG. 4 is a computed crystal drawing of an eitelite crystal displaying in perspective the form depicted in FIG. 2*b;*

FIG. 3 and FIG. 4 are computed crystal drawings of eitelite crystals displaying the forms observed in the photomicrographs reproduced in FIGS. 1 and 2, displayed in perspective. Drawing created using SHAPE software, IBM-PC Version 3.1. (Software: Copyright 1989 by Eric Dowty, 521 Hidden Valley Road, Kingsport, Tenn. 37663) The parameters for reproducing these illustrations in SHAPE are as follows: Crystal class: B3; a, c: 4.9423, 16.396; hkl and distance as: 0 0 1 x; 1 0 1 y; 0 1 2 z, where for FIG. 3 the distances chosen for x, y, z are 9,9,6, respectively and where for FIGS. 4 and 5 the distances are 5, 9, 6, respectively.

Figure 5:
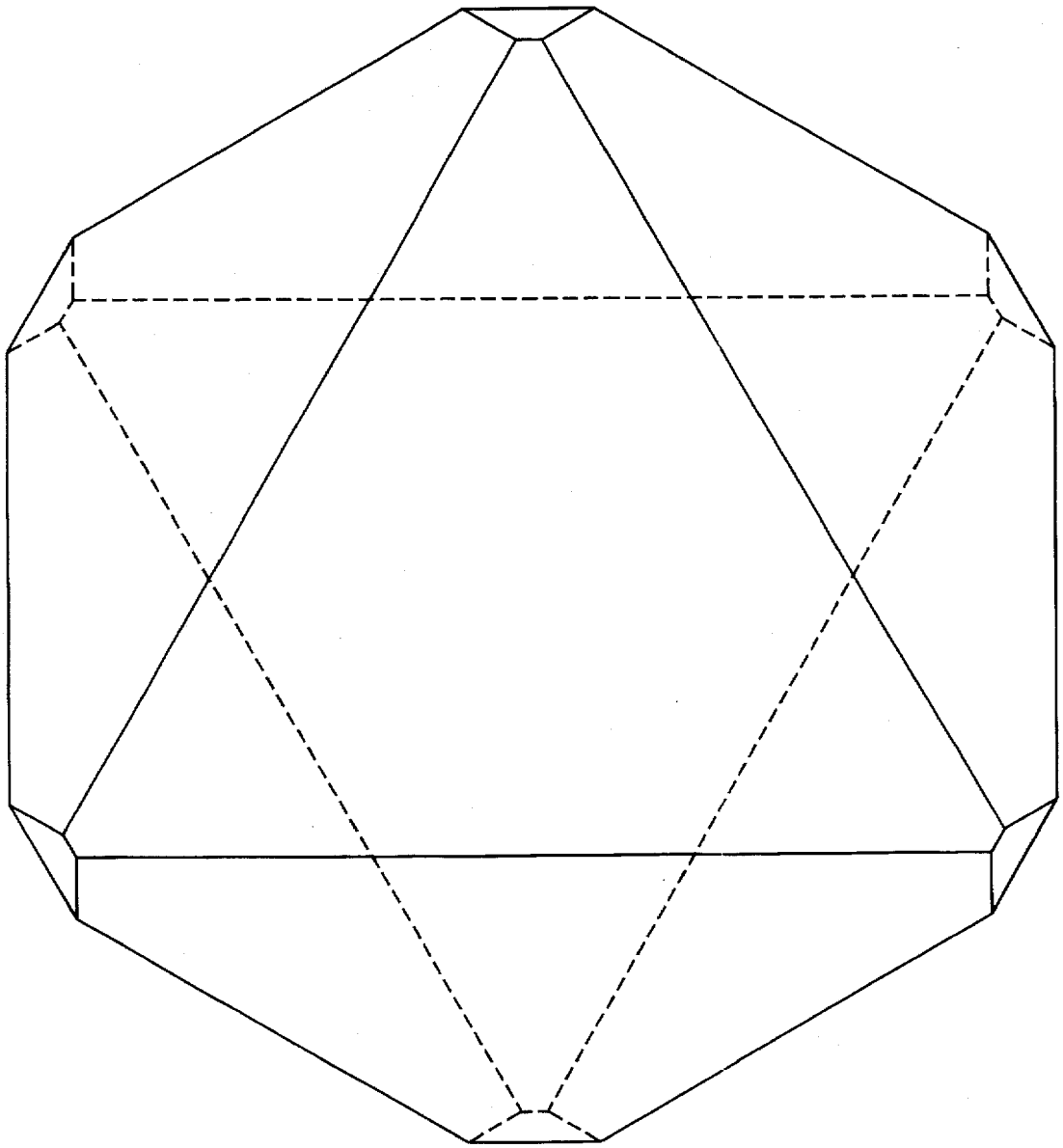
FIG. 5 is a computed crystal drawing of the eitelite crystal of FIG. 4, displayed with c-axis vertical.
Figure 6A:
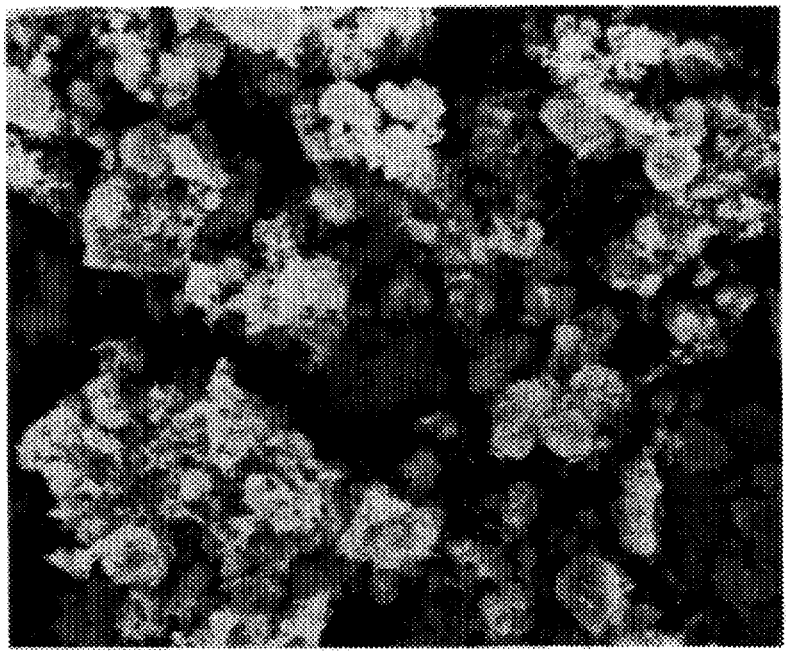
FIG. 6*a* is a photomicrograph of partially hydrolyzed eitelite (i.e. after being stirred in water at room temperature for three days), at 1000× (A)
Figure 6B:
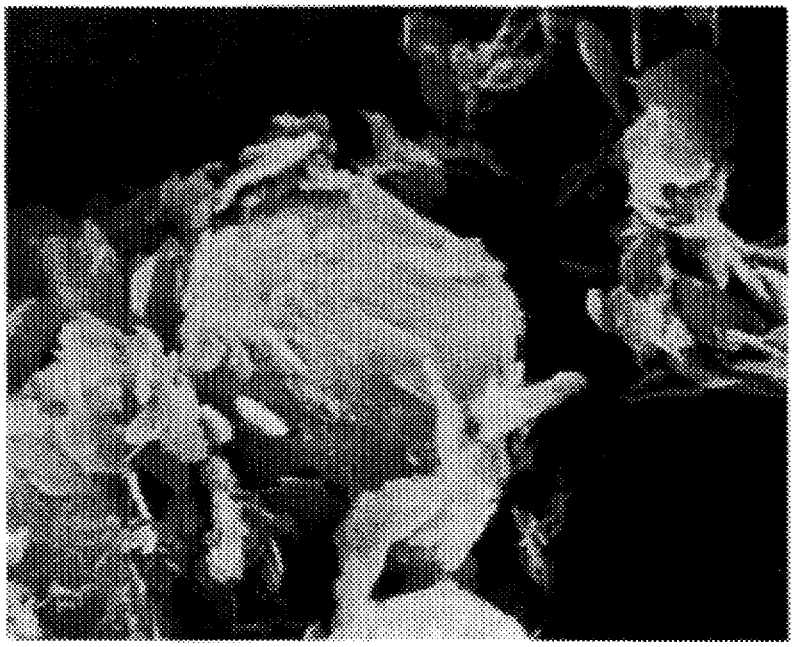
FIG. 6*b* is at 10,000× (B), with corresponding EDS (FIG. 6*c* corresponding to 6*a* and FIG. 6*d* corresponding to 6*b*) confirming the presence of sodium and magnesium.
Figure 6C:
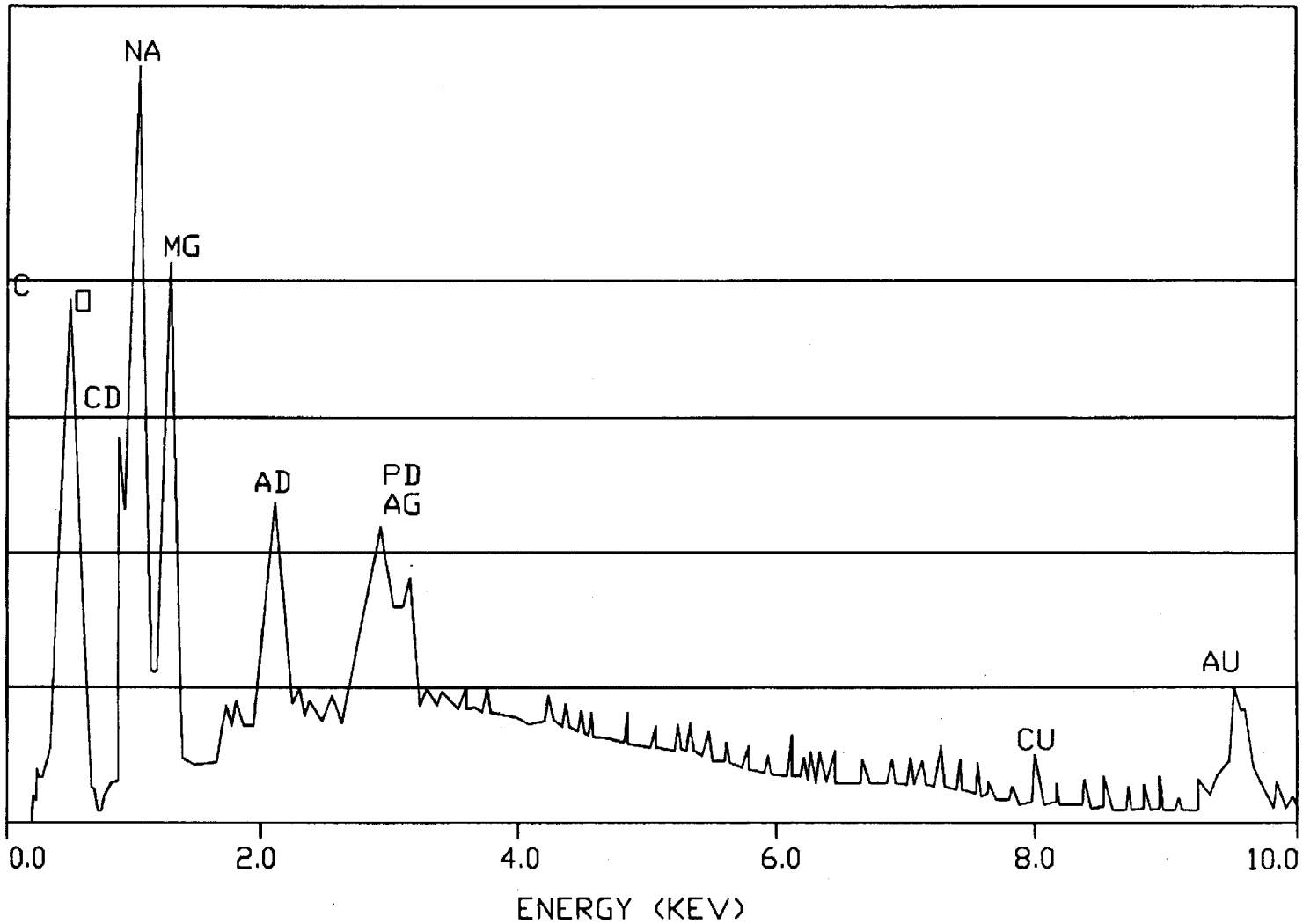
Figure 6D:
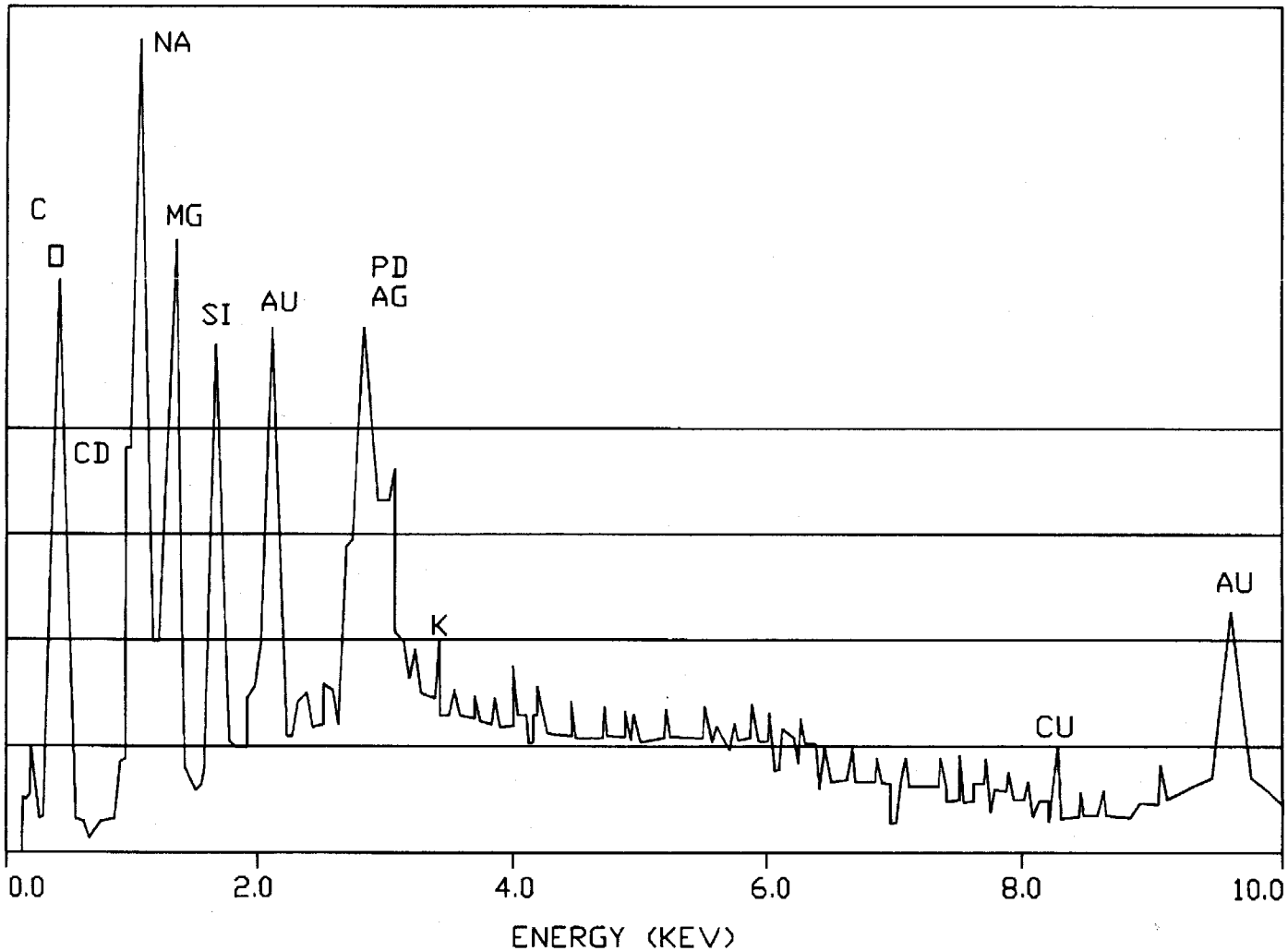
Figure 7A:
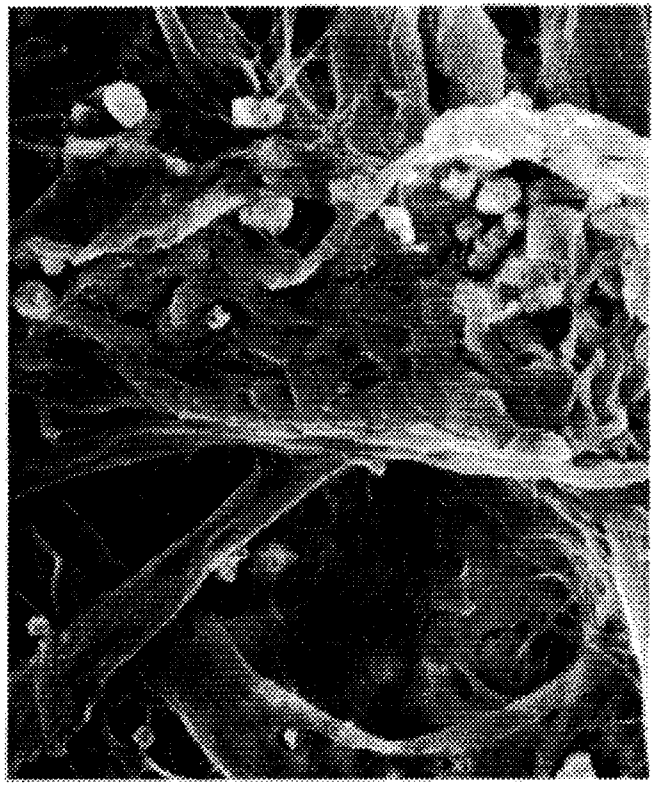
FIG. 7*a* is a photomicrograph of the handsheet of Example 2, paper sample 1, at 1000× (front), FIG. 7*b* 1000× (back)
Figure 7B:
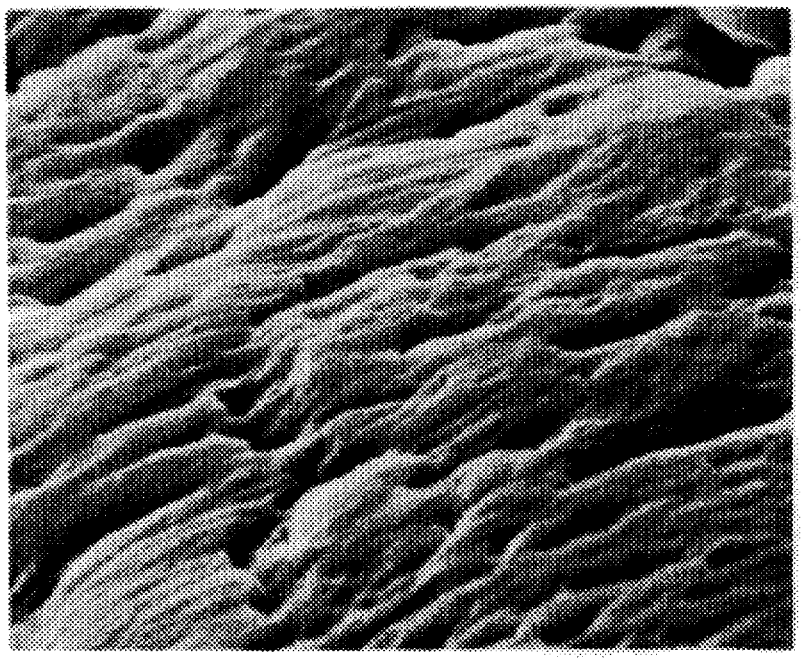
FIG. 7*c* is at 10,000×.
FIG. 7*d* is an EDS of the sheet depicting an area depleted in sodium, but retaining magnesium and potassium.
Figure 7C:
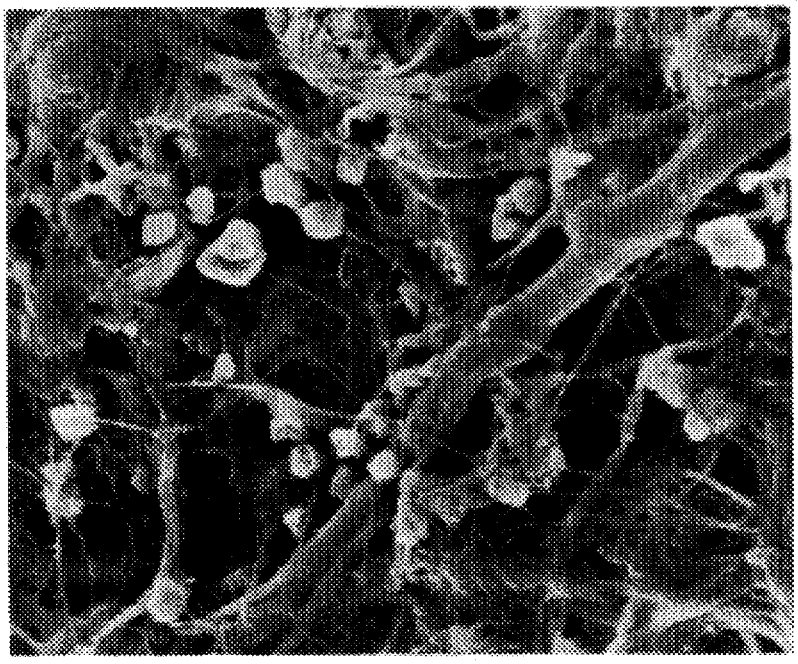
Figure 7D:
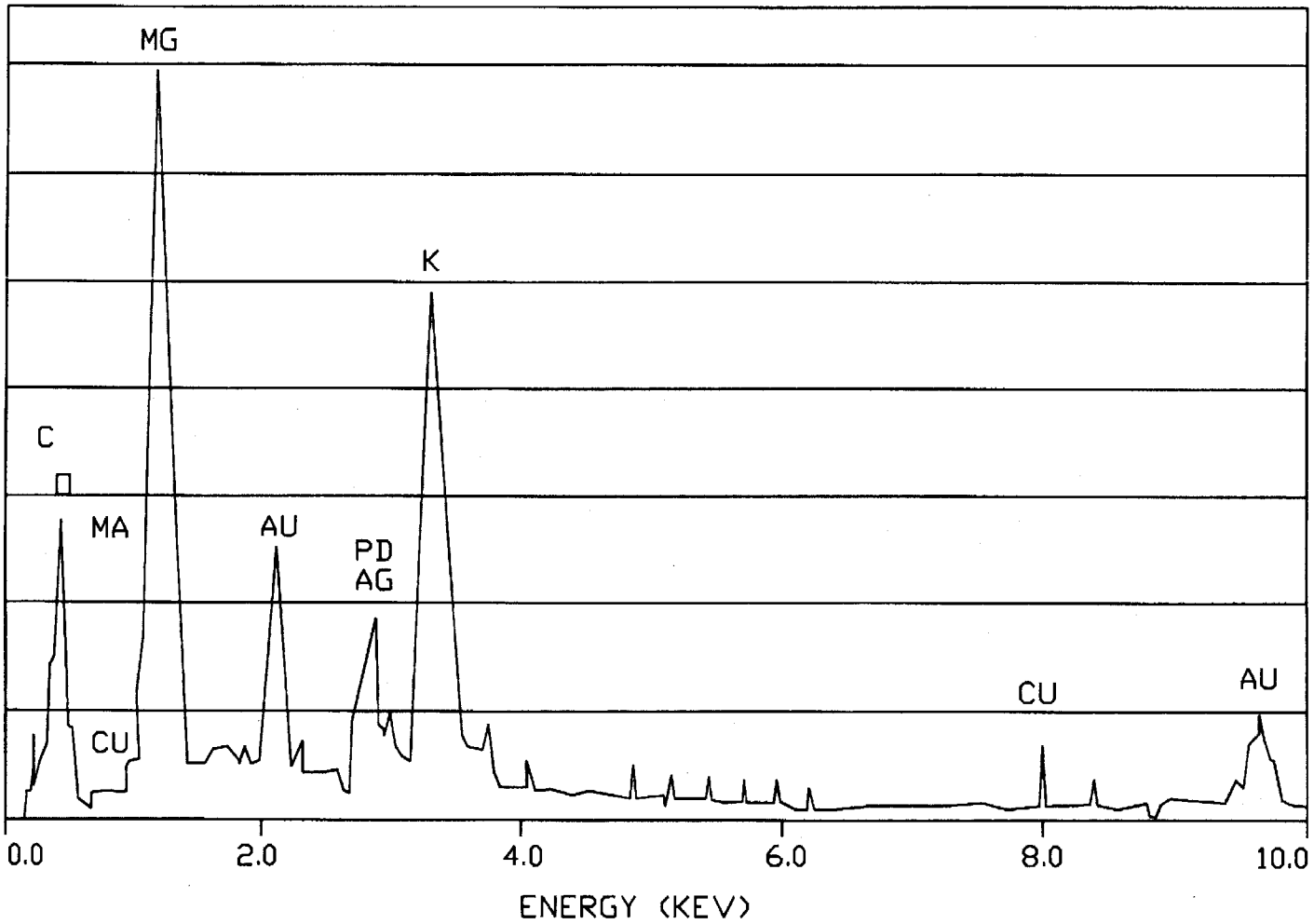
Figure 8A:
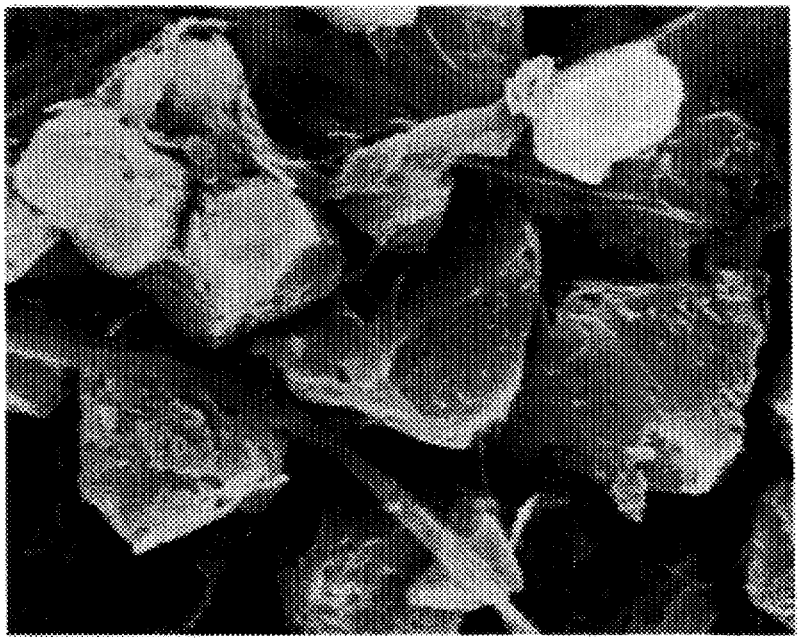
FIG. 8*a* is a photomicrograph of a handsheet of Example 2, paper sample 1, at 5000× (A)
Figure 8B:
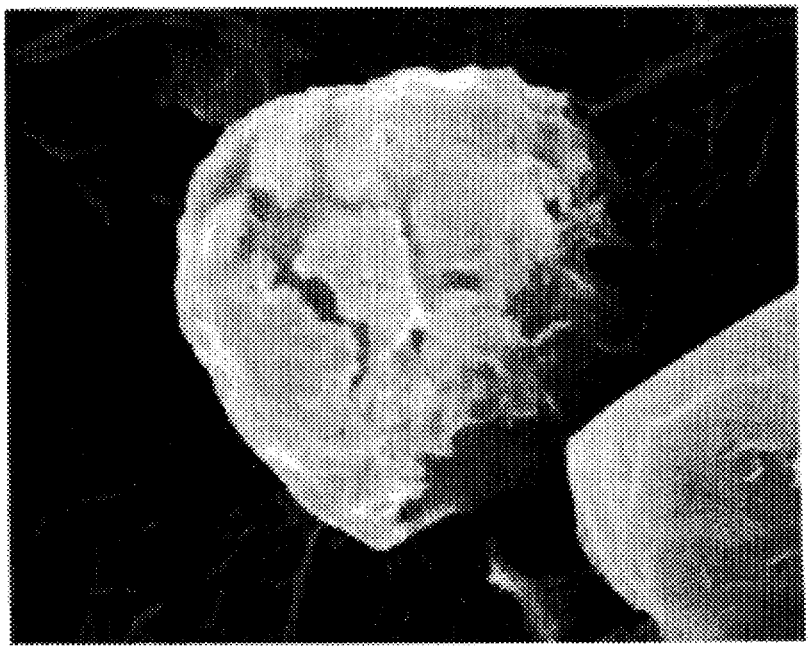
FIG. 8*b* is at 10,000×, especially targeting the incorporated eitelite particles. The accompanying EDS (FIG. 8*c* and 8*d*) confirm the presence of sodium and magnesium in the incorporated eitelite particles.
Figure 8C:
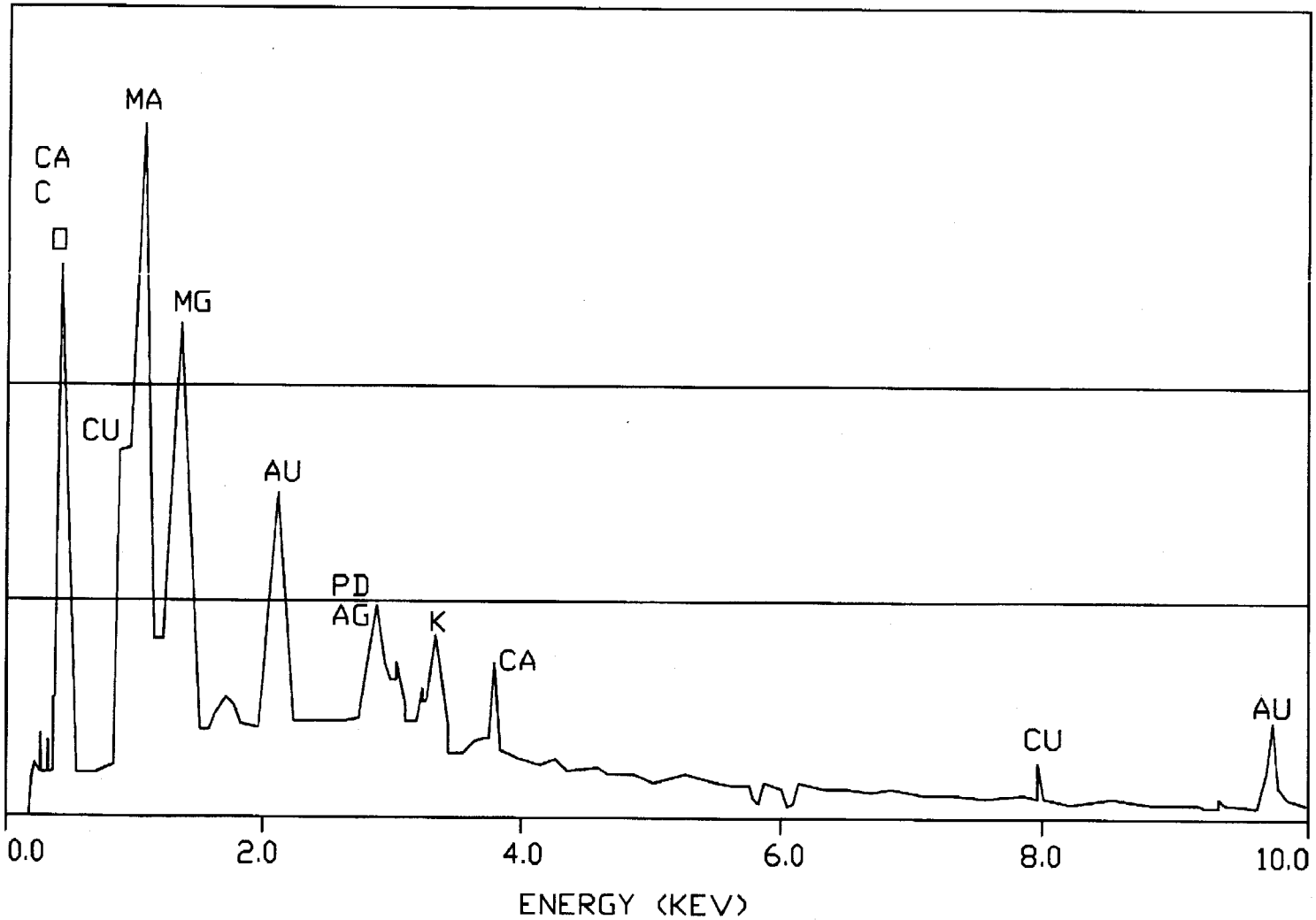
Figure 8D:
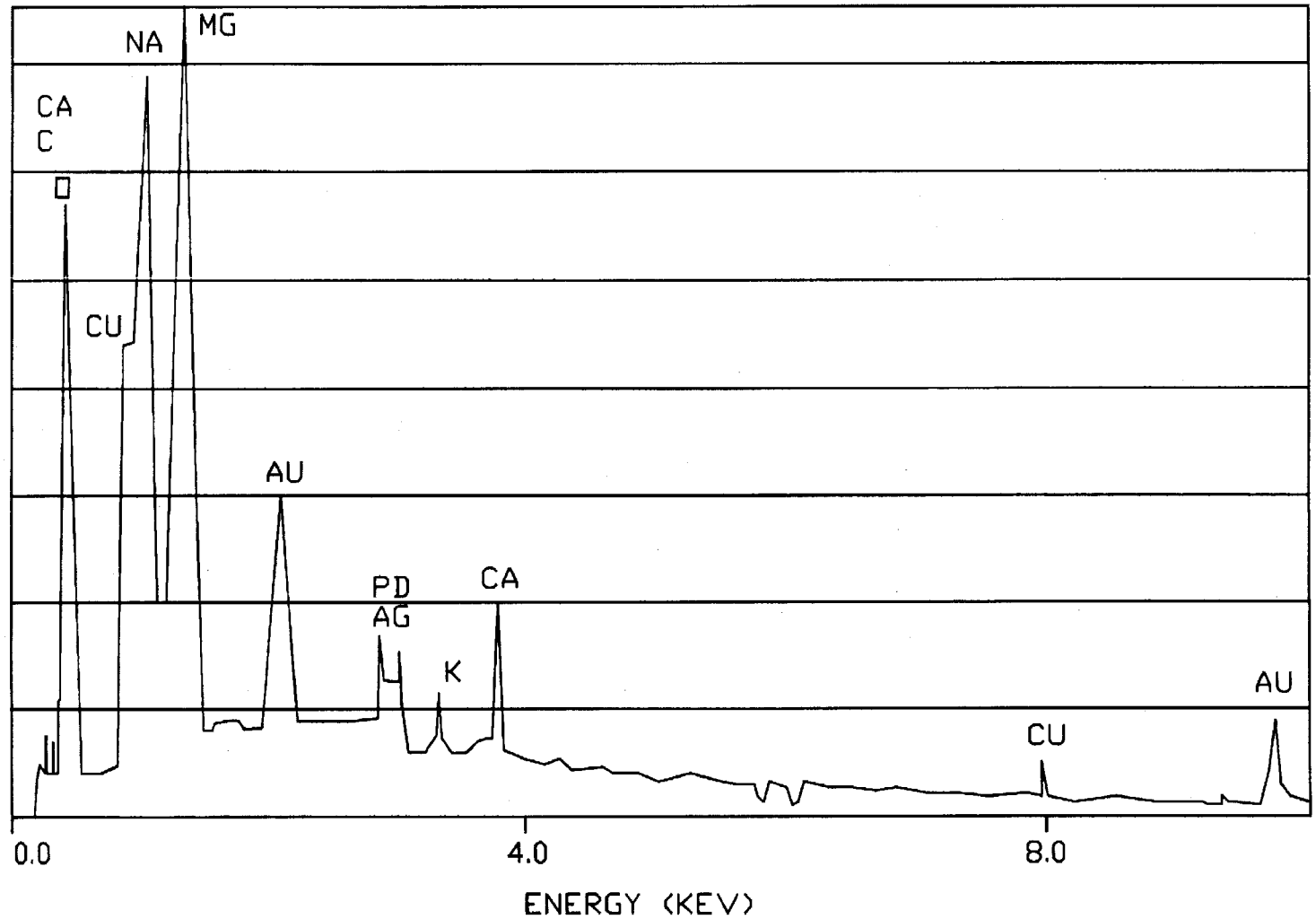

FIG. 5 is a computed crystal drawing of the eitelite crystal of FIG. 4, displayed with c-axis vertical. This provides a head-on view of the basal pinacoid {0001}. Drawing created using SHAPE software, as above.

FIG. 6 depicts photomicrographs of eitelite, after being stirred in water at room temperature for three days. Note the corroded appearance of the crystals and the loss of euhedral morphology. Note also the development of a thin scattering of plates of hydromagnesite encrusting the eitelite remnants. FIG. 6A is at 1000×, and FIG. 6B is at 10,000× magnification. The respective EDS (C and D) show the continued presence of sodium as well as magnesium.

FIGS. 7 and 8 depict photomicrographs of the handsheet of Example 2, paper sample 1. FIGS. 7A and 7B are at 1000×, FIG. 8A is at 5,000×, and FIGS. 7C and 8C are at 10,000× magnification. Note the corrosion and pitting or etching of the eitelite crystals, some of which have largely preserved the distinctive euhedral morphology seen in FIG. 1.

The specific mechanisms involved in the control of sidestream smoke by components of the paper wrappers is uncertain. While not wishing to be bound by theory, one of the mechanisms by which sidestream smoke emission reduction is thought to occur is the formation of a ceramic sheath. Given this premise, eitelite, with its considerable content of the highly fluxible alkali metal, sodium, was thought to be especially suitable for the formation of such a ceramic sheath. By being able to fuse or melt at temperatures near those found at the surface of a burning cigarette, a fluxible filler such as eitelite could form a cylinder sufficiently impervious to vapor transit as to effect diminution of emission of visible sidestream smoke.

Alternatively, if the mechanism of sidestream reduction involves a self-sealing of the paper by the induced condensation of volatiles from the vapor phase, then eitelite, with its high content of the low atomic-weight metals sodium and magnesium, was thought to have a higher heat capacity.

The role of the water-soluble sizing agents, usually organic or inorganic salts of potassium, of considerable hygroscopicity, may be to promote the condensation of water from the vapor phase in that region from which sidestream smoke emission typically occurs. The resulting aqueous condensate would then occupy much of the pore volume in the paper and retard the transit of the vapors whose subsequent condensation leads to the formation of visible sidestream smoke.

Alternatively, or in addition, the low melting points of the potassium salts provided by the fluxing or sizing agents, can lead to the formation of a ceramic sheath by the ash, which further directs or impedes the transit of vapors whose condensation could lead to the formation of visible sidestream smoke. To the extent that the formation of a ceramic sheath can contribute to the reduced emission of sidestream smoke, both the sizing agents and the eitelite filler would be thought to contribute beneficially.

Furthermore, the facile fluxing action of both sizing agents and eitelite filler leads to enhanced ash coherence (lack of flaking). This benefit from the selection of eitelite was found to occur when eitelite was incorporated into cigarette paper as a filler component, either alone or in admixture with other fillers.

Like all other magnesium carbonates, eitelite pyrolyzes to form magnesium oxide at temperatures obtained at the char line. Sodium carbonate forms as well. Magnesium hydroxide, magnesite, and hydromagnesite, all known to be capable of effecting the reduction in emissions of visible sidestream smoke, are also pyrolyzed to magnesium oxide under conditions which obtain at the char line. Since much visible sidestream smoke emission can be demonstrated photographically to emanate from a region to the smoker's side of the charline, where temperatures may be lower than those needed to generate magnesium oxide from any of the above-mentioned precursors, it is likely that magnesium oxide formation is not central to the mechanism by which any of the above-mentioned magnesium-containing phases succeed in reducing visible sidestream smoke emission.

Eitelite is a known compound that has been generically described in the literature, both as the mineral eitelite, and earlier, as the synthetic compound sodium magnesium carbonate. The most important mineralogical properties of eitelite are summarized by Roberts et al. in "Encyclopedia of Minerals" Van Nostrand Reinhold, New York, 2nd Edition, 1990, 979 pp, page 245. (For original literature: see Milton et al., "New Minerals, Reedmergnerite ($Na_2O.B_2O_3.6SiO_2$) and Eitelite ($Na_2O.MgO.2CO_2$) Associated With Leucosphenite, Shortite, Searlesite, and Crocidolite in the Green River Formation, Utah.", *Amer. Mineral.*, 40, pp. 326–27, (1955); Pabst, "The Crystallography and Structure of Eitelite, ($Na_2Mg(CO_3)_2$)", *Amer. Mineral.*, 58, pp. 211–17 (1973); Deelman, "Low-Temperature Synthesis of Eitelite, $Na_2CO_3MgCO_3$," *Neues Jahrb. Mineral Monatsh.*, 1984, 10, pp. 468–80. CA 101:174844x (1984); McKie, "Subsolidus Phase Relations in the System $K_2Ca(CO_3)_2$-$Na_2Mg(CO_3)_2$ at 1 kbar: The Fairchildite $_{55}$-Buetschliite-Eitelite Eutectoid." *Amer. Mineral.*, 75, pp. 1147–50 (1990); Gmelin Handbuch der anorganischen Chemie 8.Auflage Magnesium Teil B4, pages 438–40 (1939); and Brasseur, "A Propos Des Propriétiés De L'Eitelite $Na_2Mg(CO)_3)_2$", *Bulletine de la Societé Royale des Sciences de Liège*, 36e année, n 11–12, pp. 664–65 (1967), which for sake of brevity and clarity are incorporated by reference herein.

Eitelite is also referred to as sodium magnesium carbonate, although the use of the mineralogical name eitelite is preferred, since this usage conveys specific structural information with respect to other sodium magnesium carbonates that might possibly exist under various conditions. The chemical formula for eitelite is $Na_2Mg(CO_3)_2$. Eitelite is not a physical mixture of sodium carbonate and magnesium carbonate, but rather a specific crystal structure, with an ordered arrangement of sodium and magnesium cations, associated with carbonate anions, uniformly at the level of the unit cell. Eitelite crystallizes in the rhombohedral class (specifically: Class $\bar{3}$, Space group $R\bar{3}$). "Bar Three" is crystallographic notation for a 3-fold inversion axis, the principal symmetry operation for eitelite. A threefold inversion axis means that the external morphology and the internal structure repeat themselves by a rotation around the c-axis by an angle of 120°, followed by a reflection through the center of the crystal or structure. The eitelite structure comprises three molecular formulas per standard unit cell. The unit cell dimensions, in Angstrom units, are a=4.9423 and c=16.396. Morphologically, the principal forms (i.e., crystal surfaces displayed by the crystal) are $\{0001\}$, $\{10_T1\}$, and $\{01_T2\}$; these are illustrated in FIGS. 3, 4, and 5. Eitelite has a wide range of properties, including X-ray powder pattern (see FIG. 9), index of refraction ($\omega$=1.6052, $\epsilon$=1.4502), thermal decomposition profile (See FIG. 10), specific gravity, (2.737) etc., that are unique to itself and not duplicable by any simple admixture of any other phases. cf also: "Encyclopedia of Minerals", W. L. Roberts, G. R. Rapp, Jr., J. Weber, van Nostrand, Reinhold, (First Edition) 1974, p. 186.

Eitelite is not currently known to be useful, or a significant article of commerce. As provided in Example 1, its preparation from readily available starting materials is not difficult. No reference suggesting the use of eitelite in paper wrappers for smoking articles is known.

It was not expected that eitelite could be used in wrapper papermaking. Eitelite is a double carbonate phase with magnesium and the alkali metal sodium. Double carbonate phases would be expected to dissociate as such in pure water, with complete loss of alkali carbonate to the aqueous phase. Other double carbonate phases involving magnesium or calcium with the alkali metals potassium or sodium have been investigated by this inventor: buetschliite [$K_2Ca(CO_3)_2$]; baylissite [($K_2Mg(CO_3).4H_2O$]; gaylussite [$Na_2Ca(CO_3)_2.5H_2O$]; and pirssonite [$Na_2Ca(CO_3)_2.2H_2O$]. All of these dissociated under the conditions employed to produce handsheets and could not be incorporated intact into paper, using pure water as the fluid medium in the manufacturing process. Two other phases, difficult to synthesize, fairchildite [also $K_2Ca(CO_3)_2$], and nyerereite [$Na_2Ca(CO_3)_2$], were not examined. Surprisingly, eitelite is the only such phase investigated that was stable enough in water so as to allow it to be incorporated reasonably intact into paper under usual or typical papermaking conditions.

To avoid dissociation of the other above-mentioned solid phases, the aqueous medium wherein the wrapper papermaking would be expected to occur would need to be provided with an adequate concentration of the appropriately corresponding alkali carbonate. The intention would be to place the desired mineral phase within its stability field with respect to dissociation in water, thereby preventing dissociation or decomposition during the paper-making process. Stability-fields refer to a phase diagram, wherein the conditions whereunder a phase is in thermodynamic equilibrium with its surroundings (e.g. an aqueous solution) can be defined by such parameters as temperature, pressure, or concentration.

The above-mentioned unsuccessful phases require significantly high concentrations of the corresponding alkali carbonates in order to achieve thermodynamic stability in contact with water. Such conditions are substantially similar to those under which the phases are originally synthesized. Such concentrated solutions of alkali metals would be a significant impediment for acceptance of the process for use with commercial papermaking machinery on an intermittent basis, by the usual manufacturers of cigarette papers.

As it happens, eitelite is also not in thermodynamic equilibrium in pure water, and its stability field requires significant concentrations of sodium carbonate. However and nonetheless, the kinetics of the reaction between eitelite and water is significantly slower than the corresponding reaction for any of the other above-mentioned phases examined. The kinetics of the reaction is slow enough to allow the ready formation of paper under typical commercial papermaking conditions, using pure water as the liquid medium. This was verified by monitoring the rate of sodium release to the surrounding water as a slurry of eitelite in water was stirred at room temperature over several days.

Such release could be slowed significantly, by adding relative small proportions of sodium carbonate to the aqueous medium. As can be seen from the photomicrographs of FIGS. 6 to 8, eitelite survives considerable contact with water, and the papermaking process, suffering only variable extents of surface corrosion of the crystal surfaces.

Water is the universal medium used in large scale papermaking machinery, which produce a wide range of papers. It would be a great inconvenience to temporarily switch to the use of a strong alkali carbonate solution in order to accommodate such fillers. There would also be a problem with storing or disposing of the large volumes of such solution after the production run was complete. In addition, the excess alkali salts would have to be removed from the paper itself. The use of eitelite in the paper making process avoids such problems, since the amount of sodium lost to the water is trivial over the amount of time eitelite needs to be in contact with water during the papermaking process. From among the above-mentioned double alkali carbonates, eitelite is uniquely suited to conventional paper making processes.

Though relatively stable in water, eitelite does gradually hydrolyze as sodium is leached from it and forms hydromagnesite [$Mg_5(CO_3)_4(OH)_2 4H_2O$]. This is the reverse of the equation by which hydromagnesite is formed:

$$5Na_2Mg(CO_3)_2+6H_2O \rightarrow Mg_5(CO_3)_4(OH)_2.4H_2O+2NaHCO_3+4Na_2CO_3.$$

This hydrolysis is quite slow kinetically so that paper can easily be made from eitelite. FIG. 6 shows the results of the action of water on eitelite over a three day period at room temperature. Note the surface corrosion that pits the surface of the eitelite particles, which nonetheless remain largely recognizable as eitelite. Papers (handsheets) made with eitelite have also been studied photomicrographically (see FIGS. 7 and 8); the resulting photomicrographs show the same corrosion effects on the included eitelite particles as were seen in FIG. 6. High magnification reveals the continued presence of intact crystals of eitelite. However, these crystals are typically corroded, and platelets of hydromagnesite can be observed scattered sparsely on the eitelite crystal surfaces and among the cellulose fibers of the paper.

The formation of hydromagnesite in the cellulose fibers is believed to arise late in the papermaking process, where the handsheets are heated to evaporate the excess water. Elevated temperatures accelerate the rate of dissociation of eitelite in water and the hydromagnesite formed crystallizes among the cellulose fibers. Alternatively, some or all of the hydromagnesite particles might have arisen by filtration-entrapment among the cellulosic fibers (during the paper-sheet formation) of hydromagnesite particles formed in, or dislodged into the aqueous paper-making medium.

Eitelite stirred with water at room temperature remains at least 80% intact as partially hydrolyzed eitelite after 3 days. A kinetic study showed that the rate of release of sodium to the water slowed with time. Thus, as the sodium level built up due to the decomposition of eitelite, the rate slowed down at which this decomposition continued. A kinetic study with an initial sodium concentration of 1% showed significant slowing of eitelite decomposition, relative to an initial use of pure water.

Eitelite is used in the paper wrapper for smoking articles in an amount of about 20% to 45% by weight, when employed as the sole filler. The most preferred range is between about 25 to about 30%. The paper wrapper should have a basis weight of about 25 g/m$^2$ to about 70 g/m$^2$, preferably about 35 g/m$^2$ to about 65 g/m$^2$, and most preferably about 45 g/m$^2$. The porosity of the paper wrapper should be about 2 to about 15 Coresta units, preferably about 3 Coresta units to 10 Coresta units, and most preferably about 6 Coresta units.

Sizing agents, such as potassium succinate, potassium citrate, citric acid, potassium hydrogen malonate, or a combination of two or more of these compounds, may be used. The amount depends on which sizing agent is used. For example, potassium succinate may be applied to the paper wrapper at about 2% to about 15% by weight, preferably about 6% to about 7% by weight, and most preferably about 6% by weight.

A particular example of a paper wrapper of the present invention has about 30% by weight eitelite applied to a paper wrapper having a basis weight of about 45 g/m$^2$. The paper wrapper is sized with about 6.8% by weight dipotassium succinate.

Eitelite may be incorporated into a paper wrapper as the sole filler or may be admixed with other metal oxides or carbonates, such as magnesium or calcium carbonate, and used as a mixed filler in the fabrication of cigarette paper. These papers provide a very effective means of reducing sidestream smoke in cigarettes prepared therefrom and have no adverse effect on the ash appearance of the cigarettes.

The use of eitelite as a filler in cigarette papers results in the reduction of sidestream smoke while maintaining acceptable ash coherence. By itself or when admixed with other fillers and used as a paper filler, eitelite produced cigarettes which exhibited a reduction in sidestream smoke of as much as 87% when compared to a standard cigarette, and which had good ash coherence.

To prepare wrappers containing the fillers of the present invention, conventional cigarette papermaking procedures are used with the substitution of eitelite for the conventional calcium carbonate filler. The paper wrappers may be made from flax, wood pulp, or other plant fibers. In addition, the paper wrappers may be a conventional one wrapper construction, a multi-wrapped construction or a multilayer single wrap construction.

When used as a co-filler in the fabrication of wrappers for smoking articles, an amount of eitelite equal to 5% to 45% of the final wrapper weight should be used, preferably about 10% to 35% by weight and most preferably 25–30% by weight. Sizing agents such as alkali metal salts of carboxylic acids should be added at an amount equal to between about 2 and 15% by weight of the wrapper with the preferred salts being potassium citrate and potassium succinate. The most preferred amount of sizing agent is in the range of 5 to 8%.

In the practice of this invention the eitelite may be used alone or preferably may be blended with other fillers while maintaining acceptable reduction of sidestream smoke emission. In the case of blends, at least 40% by weight of the resulting filler should be the eitelite of the present invention, unless other fillers known to reduce sidestream emissions are also selected. The balance of the filler may comprise one or more of the following: inorganic oxides, inorganic hydroxides, and/or inorganic carbonates. These compounds can include magnesium oxide, magnesite, hydromagnesite, calcium carbonate, and titanium dioxide as well as other fillers known in the art.

In a preferred embodiment, sizing agents, such alkali metal salts of carboxylic acids or phosphoric acid, are used to adjust or control the burn rate of the resulting smoking article. Particularly good sizing agents include sodium fumarate, sodium citrate, and potassium salts, namely potassium citrate and potassium succinate, as well as monopotassium phosphate. Of these, potassium citrate and potassium succinate are preferred.

The following examples demonstrate the practice and beneficial results of this invention and should be read as illustrations of, rather than limitations on, the present invention.

EXAMPLE 1

Synthesis of Eitelite

The synthesis of eitelite has been well described in the literature. e.g. Gmelin Handbuch der anorgansischen Chemie 8. Auflage Magnesium Teil B4, pages 438–440 (1939), and references cited therein. The following reaction is believed to be one of the preferred routes to synthesizing eitelite, and was used to synthesize eitelite:

$$Mg_5(CO_3)_4(OH)_2.4H_2O+2NaHCO_3+4Na_2CO_3 >> 5Na_2Mg(CO_3)_2+6H_2O.$$

Precursors need to be chosen with care because the presence of extraneous species may lead to the formation of phases other than eitelite. Thus, in the presence of an appropriate ratio of sodium chloride, northupite [$Na_3Mg(CO_3)_2Cl$] is obtained instead of eitelite:

$$5NaCl+Mg_5(CO_3)_4(OH)_2.4H_2O+2NaHCO_3+4Na_2CO_3 >> 5Na_3Mg(CO_3)_2Cl+6H_2O.$$

In addition, combinations of reagents which could transpose into the above system (such as magnesium chloride and sodium carbonate) would also prove unsuitable for synthesizing eitelite. Other similar phases can form if bromide or sulfate anions are present.

The following procedure was used to synthesize eitelite.

In a 2000 mL round bottom flask were placed hydromagnesite (basic magnesium carbonate) (282.89 g, 0.6049 mole, 3.0247 g-atom Mg), $NaHCO_3$ (201.72 g, 2.401 moles; theory is 101.64 g, 1.21 moles) and $Na_2CO_3$ (503.87 g, 4.7539 moles; theory is 256.47 g, 2.4197 moles). The solids were mixed thoroughly, then water (1000 mL) was added to form a mixture. Further water (160 mL) was added to thin the mixture. The mixture was heated in a water bath (100° C.) for 4 hours, although the hydromagnesite appeared to have been consumed within the first three hours. The solids were filtered off hot, and rinsed with water (3×100 mL). The product was then washed with 50% (v/v) aqueous ethanol (200 mL), and finally with 95% ethanol (2×100 mL). The filter cake was dried under suction. The resulting solids were spread out in a tray between filter papers to dry in air at room temperature.

Figure 9:
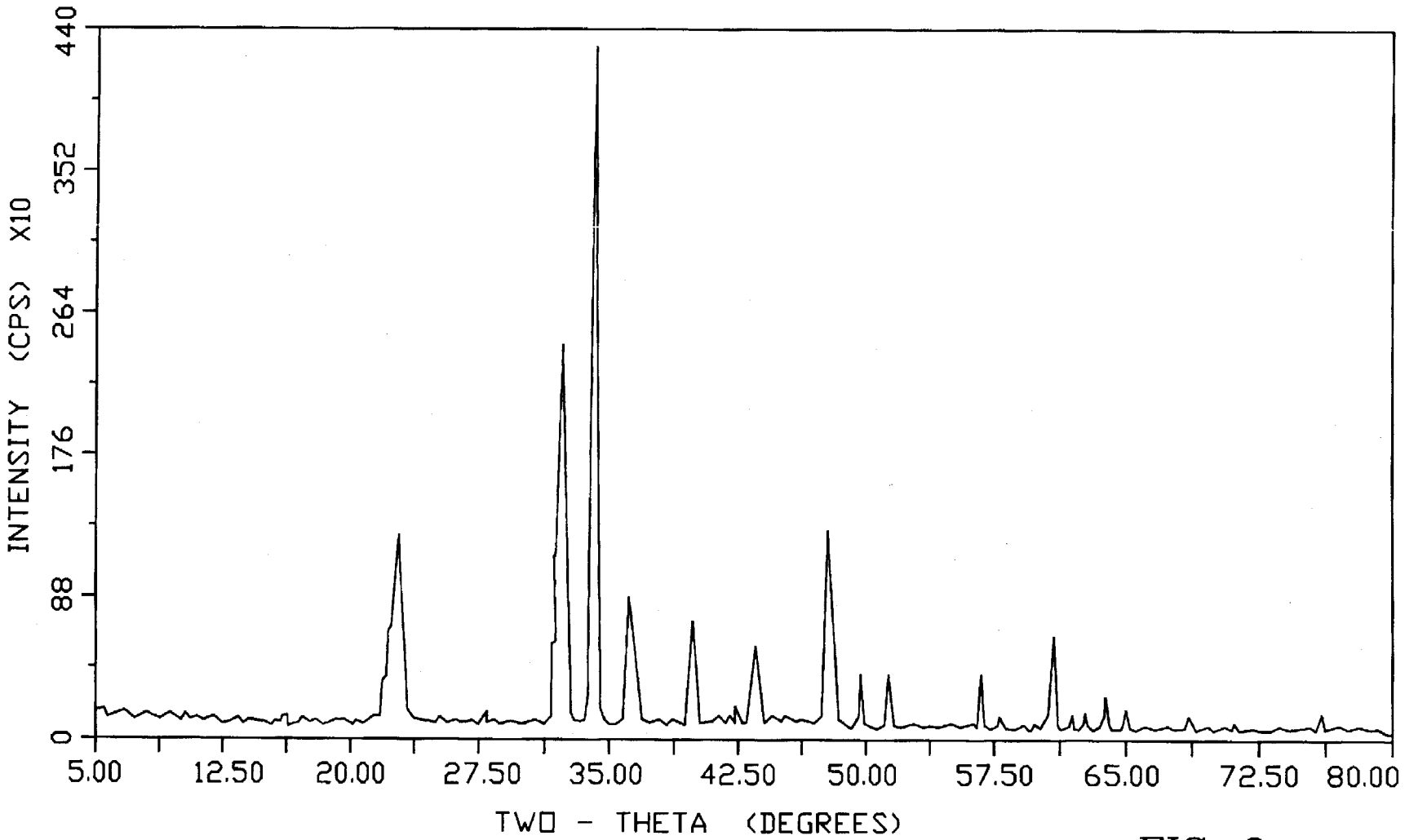
FIG. 9 is an X-ray power diffraction pattern of eitelite as prepared in Example 1.
Figure 10:
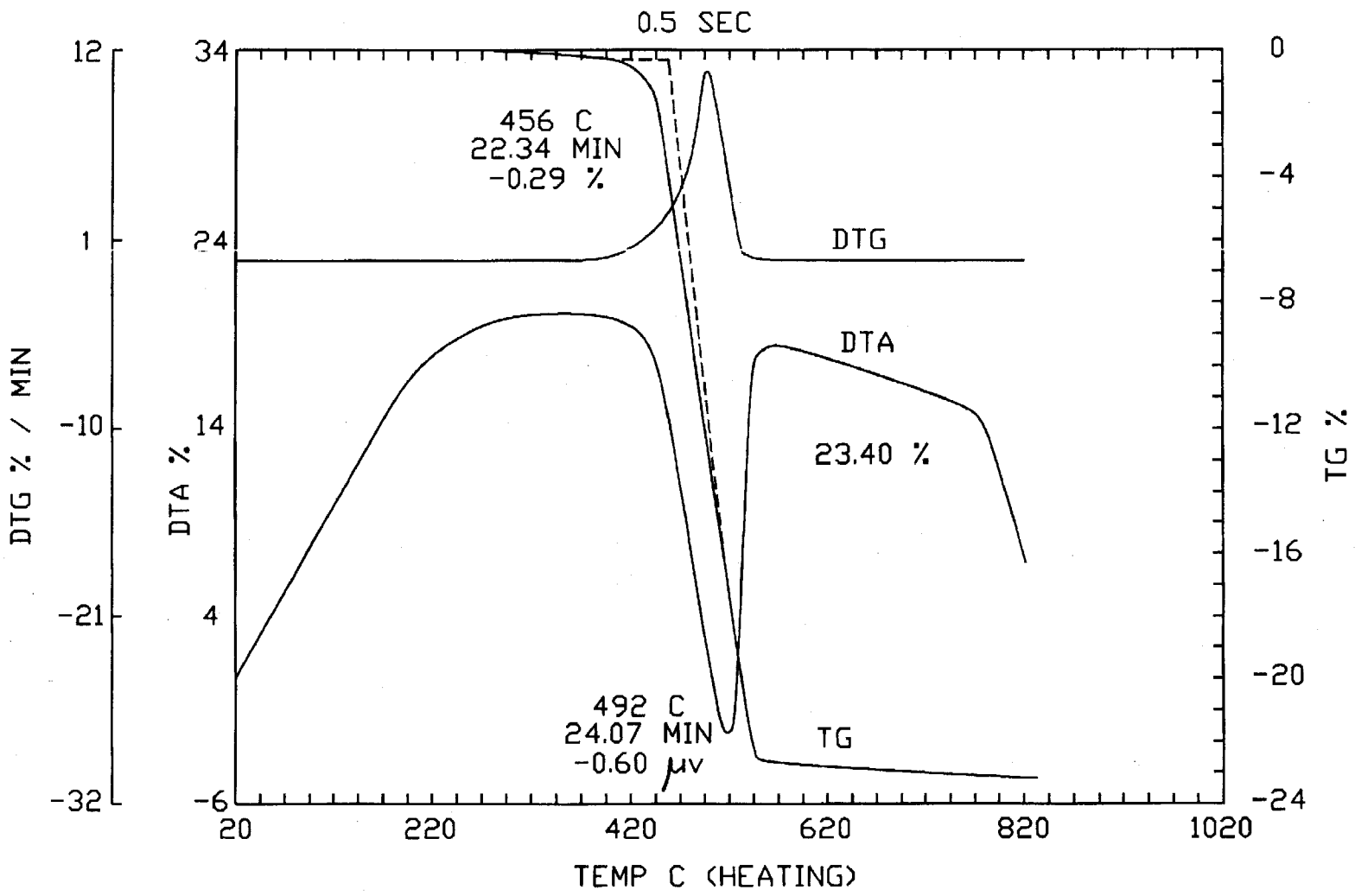
FIG. 10 is a thermogravimetric/differential thermal analysis (TG/DTA) of eitelite as prepared in Example 1. TG is thermogravimetric analysis, DTG is differential thermogravimetric analysis, and DTA is differential thermal analysis. The initial sample size was 6.856 mg, while the reference was 150 mg of platinum. Air flow was 50 ml/min and the temperature change per unit time was 20 degrees C. per minute.

The yield obtained using this procedure was 564.24 g (98%). The X-ray diffraction pattern conformed to the JCPDS file (card #24-1227), as expected for eitelite (FIG. 9). By TG/DTA (FIG. 10) carbon dioxide is lost above an onset temperature of about 455° C. and evolves through about 492 C to give magnesium oxide and soda ash. The latter fuses at 857° C. The thermal decomposition reaction is as follows:

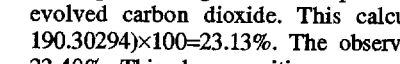

$$Na_2Mg(CO_3)_2.MgO+Na_2CO_3+CO_2$$

The expected weight loss corresponds to the weight lost as evolved carbon dioxide. This calculates as (44.0098/190.30294)×100=23.13%. The observed weight loss was 23.40%. This decomposition occurred with a maximum absorption of heat at 492° C.

The reaction followed in the synthesis of eitelite:

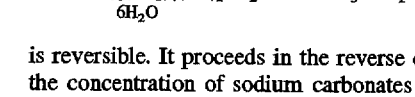

$$Mg_5(CO_3)_4(OH)_2.4H_2O+2NaHCO_3+4Na_2CO_3 >> 5Na_2Mg(CO_3)_2+6H_2O$$

is reversible. It proceeds in the reverse direction whenever the concentration of sodium carbonates is below a certain level, which is a function of temperature and pressure. This minimum concentration can in principle be plotted in the form of a standard phase diagram, so as to define part of the boundary of the stability field for eitelite. The formation of eitelite has been reported at low temperature, but occurs most readily upon heating to above circa 65° C., under ambient pressure.

The sodium carbonates need to be taken in adequate excess to ensure a final concentration within the stability field of eitelite at the end of the reaction, in order for the formation of eitelite to proceed to completion. The larger the relative volume of solution, the more a relative excess of sodium salts will be required to achieve this minimal concentration. There is thus a considerable advantage to be derived from minimizing the proportion of solution employed. When the proportion of water is minimized, as in the example the initial reaction mixture is very viscous, with the hydromagnesite behaving almost gelatinous; only part of the sodium salts dissolve initially. As the reaction progresses, the viscous hydromagnesite is replaced by a dense crystalline slurry of product, and the remaining starting sodium salts pass into solution. The product is readily recovered by filtration.

EXAMPLE 2

Cigarette Papers Prepared with Eitelite

Eitelite prepared as described in Example 1 was used as a filler for cigarette wrappers which were in turn used to prepare a series of cigarettes. The cigarette wrappers were constructed by combining flax fibers with approximately 30%, 35% or 40% by weight of eitelite, as shown in Table I. The fiber and filler slurries were then cast on a handsheet mold to a target basis weight of 45 g/m$^2$ or 65 g/m$^2$.

After being dried, the wrappers were treated with a solution of potassium succinate, potassium citrate, or a mixture of potassium citrate and citric acid (10:3), as a sizing agent. The papers then were used to fabricate cigarettes using a commercial blend of tobaccos.

NOTE: In the tables below, weight % eitelite are the nominal targeted levels of eitelite, as measured before the application of sizing agent. Targeted filler levels were deduced from differences in basis weights between papers made with a filler, and those made employing an identical quantity of cellulose, without filler.

It was later established that differential retention was occurring between filler and cellulose, and that a higher proportion of cellulose might be retained in the presence of filler, than in the absence thereof. Therefore, it eventually became routine to analyze handsheet samples for sodium and magnesium as well as potassium to establish actual levels of filler and sizing agents. These analyzed values for the filler are given in parentheses, and represent an average based on the values determined for sodium and magnesium. The analyzed values for eitelite are inevitably less than the targeted values. This is due to the differential retention between cellulose and filler, and the circumstance that the targeted values pertain to the paper before the addition of sizing agent and the analyzed values pertain to the paper after the addition of sizing agent.

TABLE I

| Paper Sample | Weight % Eitelite | Basis Weight | Porosity (Coresta) | Sizing agent (Weight %) | Compound |
|---|---|---|---|---|---|
| 1 | 30% | 45.6 g/m$^2$ | 3.3 | 6.8% | potassium succinate |
| 2 | 30% | 45.6 g/m$^2$ | 4.3 | 6.0% | potassium succinate |
| 3 | 40% | 45.2 g/m$^2$ | 8.6 | 6.2% | potassium succinate |
| 4 | 35% | 65.0 g/m$^2$ | 4.8 | 8.4% | potassium succinate |
| 5 | 30% (23.7%) | 45.0 g/m$^2$ | 5.0 | 6.7% | potassium succinate |
| 6 | 30% (23.7%) | 45.0 g/m$^2$ | 4.9 | 6.7% | potassium succinate |
| 7 | 30% (23.3%) | 45.0 g/m$^2$ | 4.6 | 6.5% | potassium succinate |
| 8 | 30% | 45.2 g/m$^2$ | 4.7 | 5.7% | potassium succinate |
| 9 | 40% | 45.2 g/m$^2$ | 9.6 | 7.3% | potassium citrate |
| 10 | 35% | 65.0 g/m$^2$ | 5.0 | 12.0% | potassium citrate |
| 11 | 35% | 65.0 g/m$^2$ | 6.0 | 7.8% | potassium citrate |
| 12 | 30% (24.3%) | 45.2 g/m$^2$ | 5.8 | 13.2% | potassium citrate/ citric acid (10:3) |
| 13 | 30% | 45.2 g/m$^2$ | 5.5 | 11.6 | potassium citrate/ citric acid (10:3) |

Sample 8—the eitelite was partially hydrolyzed by stirring and slurried with water for 3 days before being made into paper. By analysis, the resulting paper contained 23.6% eitelite and 2.7% hydromagnesite.

Sample 13—The eitelite was partially hydrolyzed by stirring with a limited amount of water for 3 days before being made into paper.

To measure the amount of sidestream smoke generated by cigarettes made as described above, burning cigarettes were allowed to free burn while the sidestream smoke traveled through a photocell through which light was passed. The photocell detected the transmitted light intensity during the burning of 30 mm of the tobacco rod. The measured light intensity over the course of burning was determined and compared to the light intensity when no smoke is present in the photocell. An extinction coefficient ("EC") was calculated based on the Beer-Lambert Law.

The ECs of the cigarettes containing the fillers of the present invention were compared with the EC of a control cigarette. The results are reported in Table II below as the percent reduction in the EC. The control was typically an 85 or 100 mm commercial cigarette having a 25 g/m$^2$ paper wrapper with a porosity of about 30 CORESTA units and a citrate salt of potassium and/or sodium sizing agent. Test cigarettes were made by hand at comparable packing densities using the same tobacco filler as the control. All test samples were of standard circumference (about 25 mm) and 85 to 100 mm in length including a 27 mm cellulose acetate filter.

Static Burn Time (SBT) also was measured for the cigarettes described in the foregoing. SBT is the amount of time it takes a cigarette to burn 40 mm under static conditions. In other words, it is the rate at which a cigarette smolders in the absence of drafts or puffing action. In the table below, SBT is expressed in terms of minutes.

The larger the number of the cross-product, the less desirable the model. Too high an EC means too much visible smoke is coming through; and too long a SBT means unsatisfactory burning behavior.

TABLE II

| Paper Sample | SBT | EC | EC × SBT | % EC Reduction | EGA Control |
|---|---|---|---|---|---|
| 1 | 9.8 | ** | ** | 60 | (0.80) |
| 2 | 13.4 | 0.26 | 3.48 | 69 | (0.84) |
| 3 | 12.7 | 0.21 | 2.67 | 74 | (0.82) |
| 4 | | WOULD NOT BURN | | | (0.82) |
| 5 | 12.5 | 0.28 | 3.50 | 65 | (0.79) |
| 6 | 11.4 | 0.26 | 2.96 | 67 | (0.79) |
| 7 | 12.0 | 0.27 | 3.24 | 66 | (0.79) |
| 8 | 11.6 | 0.18 | 2.09 | 72 | (0.65) |
| 9 | 12.1 | 0.24 | 2.90 | 71 | (0.82) |
| 10 | | WOULD NOT BURN | | | (0.82) |
| 11 | 15.4 | 0.11 | 1.69 | 87 | (0.82) |
| 12 | 14.1 | 0.21 | 2.96 | 73 | (0.79) |
| 13 | 8.4 | 0.31 | 2.60 | 61 | (0.79) |

Reduction based on extinction coefficient relative to a standard commercial control, having approximately the same mainstream smoke delivery, smoked on same days as the sample. Extinction coefficients for the respective controls are shown in parenthesis.
**Raw data was not recorded for EC of sample 1.

As can be seen from the above results, cigarettes made with papers containing eitelite provide significant sidestream smoke reduction relative to control cigarettes made with standard papers containing calcium carbonate as the sole filler. The high basis-weight papers (65 grams per square meter) tended either not to support sustained combustion, or to have excessively long static burn times. Higher filler contents also tended to produce longer static burn times. Best results were obtained with targeted nominal eitelite contents of around 30%, and sizing agent contents of about 6–7%. The percentage sidestream reduction does not correlate strongly, let alone proportionately, to the paper permeability as measured in Coresta units (cc of air per minute per square centimeter). For the provided examples, the Coresta permeability ranges over nearly a factor of three, while the sidestream reductions only range from 60 to 87%.

Upon evaluation, the quality of the ash of the cigarettes made as described above was judged quite acceptable. The ash had good cling, no fall-off and had near solidity. The ash color was darker than with conventional cigarettes.

EXAMPLE 3

Cigarette Papers Prepared With Eitelite And Another Filler

Cigarette wrappers were constructed as in Example 2, except that the filler was a blend of about 15% by weight eitelite and about 15% of another filler. The other filler was MULTIFEX MM (calcium carbonate, available from Pfizer Minerals, Pigments and Metals Division of Pfizer, Inc., New York, N.Y.), Baymag C Magnesite (obtained from the naturally-occurring Baymag deposit in British Columbia, Canada and custom ground by impact mill to a suitable papermaking size (99+% through 400 mesh, or median particle size 1.5–1.6 millimicrons) or commercial hydromagnesite (from Morton Thiokol). Basis weight was targeted at about 45 g/m$^2$. The papers were sized with potassium succinate, potassium hydrogen malonate or potassium citrate.

TABLE III

| Paper Sample | Other Filler | Basis Weight | Porosity (Coresta) | Sizing agent (Weight %) | Compound |
|---|---|---|---|---|---|
| 14 | MULTIFEX MM | 45.2 | 5.1 | 6.8 | potassium succinate |
| 15 | Baymag C Magnesite | 45.7 | 3.5 | 6.3 | potassium succinate |
| 16 | Baymag C Magnesite | 46.0 | 4.7 | 9.8 | potassium succinate |
| 17 | hydro-magnesite[1] | 45.4 | 7.1 | 7.8 | potassium succinate |
| 18 | MULTIFEX MM | 44.3 | 6.2 | 12.4 | potassium hydrogen malonate |
| 19 | Baymag C Magnesite | 46.0 | 5.0 | 9.8 | potassium citrate |

[1](Morton Thiokol)

EC and SBT were measured as described in Example 2. The results are listed in Table IV.

TABLE IV

| Paper Sample | SBT | EC | EC × SBT | Reduction* | EC Control |
|---|---|---|---|---|---|
| 14 | 8.4 | 0.48 | 4.03 | 43 | (0.84) |
| 15 | 10.1 | 0.30 | 3.03 | 64 | (0.84) |
| 16 | 10.9 | 0.27 | 2.94 | 67 | (0.82) |
| 17 | 8.5 | 0.46 | 3.91 | 45 | (0.84) |
| 18 | 9.9 | 0.33 | 3.27 | 60 | (0.82) |
| 19 | 10.4 | 0.27 | 2.81 | 67 | (0.82) |
| EAG | 8.3 | 0.82 | 6.81 | 0 | |
| EAG | 8.2 | 0.84 | 6.89 | 0 | |

*EC % Reduction based on extinction coefficient relative to a standard commercial control, having approximately the same mainstream smoke delivery, smoked on same days as the sample. Extinction coefficients for the respective controls are shown in parentheses.

As can be seen from the above results, cigarettes made with papers containing about 15% by weight eitelite and about 15% by weight of another filler provide significant sidestream smoke reduction relative to control cigarette made with standard calcium carbonate alone (EAG).

One skilled in the art will appreciate that the present invention may be practiced by other than the preferred embodiments which are presented above for purposes of illustration and not limitation, and the present invention is defined by the claims that follow.

What is claimed is:

1. A paper wrapper for a smoking article comprising as filler eitelite in an amount sufficient to substantially reduce the amount of sidestream smoke produced by the burning smoking article while providing the smoking article with ash coherence.

2. The paper wrapper of claim 1, further comprising inorganic oxides, inorganic hydroxides, or inorganic carbonates.

3. The paper wrapper of claim 2, where the inorganic oxide, hydroxide, or carbonate is magnesite, calcite, aragonite, magnesium hydroxide, hydromagnesite, titanium dioxide or mixtures thereof.

4. The paper wrapper of claim 1, wherein the paper wrapper contains from about 20% to about 40% of the filler by weight based on the total weight of the paper wrapper.

5. The paper wrapper of claim 1, wherein the eitelite is selected from the group consisting of anhydrous eitelite, partially hydrolyzed eitelite, and mixtures thereof.

6. A wrapper according to claim 1, wherein the wrapper contains at least one water-soluble sizing agent selected from the group consisting of alkali metal salts of carboxylic acids.

7. A wrapper for a cigarette comprising a cellulosic sheet containing as filler from about 10% to about 30% eitelite selected from the group consisting of anhydrous eitelite, partially hydrolyzed eitelite, and mixtures thereof; from about 10% to about 30% of an additional filler compound selected from the group consisting of magnesite, calcite, aragonite, magnesium hydroxide, hydromagnesite, titanium dioxide, and mixtures thereof; the wrapper having a basis weight of between 25 $g/m^2$ and 70 $g/m^2$, and a porosity of from 2 to 15 Coresta units.

8. A wrapper according to claim 7, wherein the wrapper contains from 2 to 15% of at least one water-soluble sizing agent selected from the group consisting of potassium succinate; potassium citrate; citric acid; and potassium hydrogen malonate.

9. A smoking article comprising a tobacco charge and a wrapper according to claim 1.

10. A cigarette comprising a tobacco rod and a wrapper for the tobacco rod, said wrapper comprising a cellulosic sheet containing, as a filler, from about 10% to about 30% of eitelite selected from the group consisting of anhydrous eitelite, partially hydrolyzed eitelite, and mixtures thereof; from about 10% to about 30% of at least one additional filler compound selected from the group consisting of magnesite, calcite, aragonite, magnesium hydroxide, titanium dioxide, and hydromagnesite; the paper wrapper further having a water-soluble sizing agent selected from the group consisting of inorganic and organic salts of potassium; the amount of sidestream smoke produced by the burning cigarette being substantially reduced while providing the cigarette with ash coherence.

11. A cigarette according to claim 10, wherein the water-soluble sizing agent is potassium citrate or potassium succinate in an amount from 2 to 15%.

12. A method for reducing visible sidestream smoke emanated from a smoking article, comprising the step of wrapping a tobacco rod of the smoking article in a combustible cellulosic sheet containing eitelite selected from the group consisting of anhydrous eitelite, partially hydrolyzed eitelite, and mixtures thereof, the eitelite being present in an amount sufficient to substantially reduce the visible sidestream smoke while maintaining ash coherence.

13. A method according to claim 12, further comprising sizing the cellulosic sheet with at least one water-soluble salt of an alkali metal salt of carboxylic acids or phosphoric acid.

14. A method of preparing a paper mapper for a smoking article, comprising the step of incorporating eitelite into a cellulosic base web, the eitelite selected from the group consisting of anhydrous eitelite, partially hydrolyzed eitelite, and mixtures thereof; the eitelite being in an amount sufficient to substantially reduce visible sidestream smoke while maintaining ash coherence.

15. A method for preparing a cigarette, comprising the step of incorporating eitelite selected from the group consisting of anhydrous eitelite, partially hydrolyzed eitelite, and mixtures thereof in a filler for the cigarette wrapper, the filler being incorporated in an amount sufficient to substantially reduce the amount of visible sidestream smoke while maintaining ash coherence; sizing the wrapper with at least one sizing agent selected from the group consisting of water-soluble potassium salts; and fabricating the article with the wrapper about a tobacco rod, the wrapper having a basis weight of 25 to 70 $g/m^2$; a sizing weight of 2 to 15%; and a porosity of 2 to 15 Coresta units.

* * * * *